US010909815B2

(12) United States Patent
Donadio

(10) Patent No.: US 10,909,815 B2
(45) Date of Patent: Feb. 2, 2021

(54) METHOD AND APPARATUS FOR ADMINISTERING A TOKEN COLLECTING GAME

(71) Applicant: Bally Gaming, Inc., Las Vegas, NV (US)

(72) Inventor: Mark N. Donadio, Boulder City, NV (US)

(73) Assignee: SG Gaming, Inc., Las Vegas, NV (US)

( * ) Notice: Subject to any disclaimer, the term of this patent is extended or adjusted under 35 U.S.C. 154(b) by 49 days.

(21) Appl. No.: 16/245,612

(22) Filed: Jan. 11, 2019

(65) Prior Publication Data

US 2019/0244487 A1 Aug. 8, 2019

Related U.S. Application Data

(60) Provisional application No. 62/626,302, filed on Feb. 5, 2018.

(51) Int. Cl.
*A63F 9/24* (2006.01)
*G07F 17/32* (2006.01)

(52) U.S. Cl.
CPC ..... *G07F 17/3293* (2013.01); *G07F 17/322* (2013.01); *G07F 17/3211* (2013.01); *G07F 17/3272* (2013.01)

(58) Field of Classification Search
CPC ..... G07F 17/3293; G07F 17/3272; G07F 17/3211; G07F 17/322
See application file for complete search history.

(56) References Cited

U.S. PATENT DOCUMENTS

| | | | | |
|---|---|---|---|---|
| 5,632,483 | A | 5/1997 | Garczynski et al. | |
| 5,660,391 | A | 8/1997 | Klasee | |
| 5,669,816 | A | 9/1997 | Garczynski et al. | |
| 5,673,917 | A | 10/1997 | Vancura | |
| 5,743,532 | A | 4/1998 | Lafferty | |
| 5,799,946 | A | 9/1998 | Groussman | |
| 5,806,846 | A | 9/1998 | Lofink et al. | |
| 5,947,822 | A | 9/1999 | Weiss | |
| 6,158,741 | A | 12/2000 | Koelling | |
| 6,182,968 | B1 | 2/2001 | Wilkinson | |
| 6,182,969 | B1 * | 2/2001 | Green | A63F 3/00157 273/292 |
| 6,305,689 | B1 * | 10/2001 | Webb | A63F 3/00157 273/274 |
| 6,305,690 | B1 * | 10/2001 | Webb | A63F 3/00157 273/274 |
| 6,336,635 | B1 | 1/2002 | Baer | |

(Continued)

*Primary Examiner* — Dmitry Suhol
*Assistant Examiner* — Carl V Larsen

(57) ABSTRACT

A method and apparatus are set forth for playing a token collecting game based upon Blackjack. Using a card reading device the dealer completes their hand first according to the rules based on Blackjack before the players have to act. The card reading device reads the cards of the dealer's hand and instructs the dealer whether to draw another card for the dealer hand until the dealer's hand is completed. Thereafter the players compete their hands armed with the knowledge of the exposed card of the dealer's initial two-card hand and the number, but not the values of, cards required to complete the dealer's hand. After the players have completed their hands each player's hand is resolved against the dealer according to the rules of Blackjack.

17 Claims, 11 Drawing Sheets

(56) References Cited

U.S. PATENT DOCUMENTS 6,416,406 B1 7/2002 Duhamel
6,481,718 B2 11/2002 Koelling
6,523,831 B2 2/2003 Webb
6,582,301 B2 6/2003 Hill
6,685,189 B2 2/2004 Cherven
6,755,741 B1 6/2004 Rafaeli
6,808,173 B2 10/2004 Snow
7,066,466 B1 6/2006 Stavinsky et al.
7,255,351 B2 8/2007 Yoseloff et al.
7,435,172 B2 10/2008 Hall
7,523,941 B2 4/2009 Thomas et al.
7,530,572 B2 5/2009 Thomas et al.
7,637,506 B2 12/2009 Naicker
7,661,676 B2 * 2/2010 Smith ..... A63F 1/00 273/149 R
7,677,565 B2 3/2010 Grauzer et al.
7,901,285 B2 3/2011 Tran et al.
7,934,980 B2 5/2011 Blaha et al.
7,946,586 B2 5/2011 Krenn et al.
7,954,821 B2 6/2011 Reabe, Jr.
8,043,151 B2 10/2011 Pickelhaupt
8,062,119 B2 11/2011 Stern et al.
8,070,574 B2 12/2011 Grauzer et al.
8,150,158 B2 4/2012 Downs, III
8,177,614 B2 5/2012 Hall
8,197,319 B2 6/2012 Nicely
8,262,475 B2 9/2012 Snow et al.
8,272,958 B2 9/2012 Smith et al.
8,286,967 B2 10/2012 Sparago
8,328,623 B2 12/2012 Stern et al.
8,371,917 B2 2/2013 Hall
8,511,684 B2 * 8/2013 Grauzer ..... A63F 1/14 273/149 P
8,579,289 B2 11/2013 Rynda et al.
8,747,203 B1 6/2014 Hedge, Jr. et al.
8,905,403 B2 12/2014 Loewenstein et al.
8,974,305 B2 3/2015 Costello et al.
9,120,007 B2 9/2015 Costello et al.
9,289,677 B2 * 3/2016 Schubert ..... A63F 1/14
9,370,709 B1 6/2016 Hedge, Jr. et al.
9,370,710 B2 6/2016 Grauzer et al.
9,483,915 B2 11/2016 Gilbertson et al.
RE46,505 E * 8/2017 Hill ..... A63F 1/14
9,761,080 B2 9/2017 Snow
9,965,924 B2 5/2018 Moskowitz
10,083,576 B1 9/2018 Hedge, Jr. et al.
2001/0000933 A1 5/2001 Koelling
2002/0000693 A1 1/2002 Webb
2003/0025271 A1 2/2003 Cherven
2003/0207706 A1 11/2003 Potter et al.
2004/0070146 A1 4/2004 Snow
2004/0100026 A1 5/2004 Haggard
2005/0035548 A1 2/2005 Yoseloff et al.
2005/0164759 A1 7/2005 Smith et al.
2005/0212213 A1 9/2005 Inglese
2005/0250569 A1 11/2005 Kane et al.
2006/0091607 A1 5/2006 Javier
2006/0208423 A1 9/2006 Loewenstein et al.
2006/0279045 A1 * 12/2006 Thomas ..... A63F 1/00 273/292
2007/0216098 A1 9/2007 Santiago
2007/0257429 A1 11/2007 Kane et al.
2008/0012223 A1 * 1/2008 Thomas ..... A63F 1/00 273/292
2008/0042354 A1 2/2008 Yoseloff et al.
2008/0067743 A1 3/2008 Naicker
2008/0102934 A1 * 5/2008 Tan ..... G07F 17/3244 463/25
2008/0119257 A1 5/2008 Stern et al.
2008/0315521 A1 12/2008 Reabe, Jr.
2009/0124313 A1 5/2009 Nicely
2009/0170582 A1 7/2009 Hall
2010/0038849 A1 2/2010 Scheper et al.
2010/0052255 A1 3/2010 Naicker
2010/0099480 A1 4/2010 Caputo
2010/0102509 A1 4/2010 Pickelhaupt
2011/0127721 A1 6/2011 Zussman et al.
2011/0227287 A1 9/2011 Reabe, Jr.
2011/0266747 A1 11/2011 Sparago
2011/0285085 A1 11/2011 Pickelhaupt
2012/0040730 A1 2/2012 Stern et al.
2012/0190430 A1 7/2012 Puyol
2012/0289311 A1 11/2012 Centrone
2012/0315969 A1 12/2012 Hall
2013/0026711 A1 1/2013 Olsen
2013/0285326 A1 10/2013 Hall
2014/0066155 A1 3/2014 Noyes
2017/0032622 A1 2/2017 Moskowitz
2017/0087473 A1 3/2017 Siegel et al.

* cited by examiner

METHOD AND APPARATUS FOR ADMINISTERING A TOKEN COLLECTING GAME

CROSS-REFERENCE TO RELATED APPLICATIONS

This application claims the benefit of priority to U.S. Provisional Patent Application Ser. No. 62/626,302 filed on 2018 Feb. 5 and entitled "METHOD AND APPARATUS FOR ADMINISTERING A TOKEN COLLECTING GAME," the contents of which are hereby incorporated by reference in their entirety.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2018, Bally Gaming, Inc.

FIELD

This disclosure relates generally to token collecting games for two or more participants and related systems and apparatuses. More specifically, disclosed embodiments relate to relate to a token collecting game having features of Blackjack including a physical or virtual game surface with markings for receiving physical or virtual game pieces during the play of the game and a playing card dealing and reading apparatus. Contrary to the known game of Blackjack the dealer's hand is completed by dealing additional cards face down (and undisclosed to the player(s)) for the dealer's hand, before the player's complete their hands. For a winning result, one or more physical tokens are awarded.

BACKGROUND

The game of Blackjack is well known. In a live table game players occupy positions about an arcuate margin of a table and a dealer occupies a dealer position opposite the players. To play the game each player registers participation in a "hand", i.e. round of play, by placing one or more tokens on a layout of the table at the position associated with the player. In this fashion the dealer and security can verify participation by the player(s). The tokens may be, where play is for fun, match sticks or other physical indicia or where play is for money the tokens may represent value such as being cash, chips or other physical item.

Once all players have indicated their participation the dealer using a shuffled, i.e. randomized, deck or physical deck of playing cards deals in a left to right (from the dealer's viewpoint) two cards to each player and two cards to himself/herself. Traditionally one card of the dealer's initial two-card hand is turned over and exposed for the players to see while the other is dealt face down. Thus, the players have some information about the dealer's hand—the value of exposed or "up" card. One aspect of the traditional game of Blackjack and one that provides an advantage to the dealer is that in most cases the player(s) must complete their hands to final hands before the dealer completes his/hers. Players may stand on their initial two cards or opt to take, serially, additional cards in an attempt to increase the value of their hand to have a final hand value as close to 21 as they can without exceeding 21, i.e. "busting" their hand. In traditional Blackjack other actions are available to the player based upon their initial two cards such as displaying a Blackjack (Ace and a 10-value card), doubling down, splitting their hand or, according to some rules, surrendering their hand where they believe the dealer may have an initial hand "Blackjack". Since players complete their hands first, a player who busts according to the rules of Blackjack loses even through the dealer may subsequently bust as well. The rules for Blackjack as well as strategies for play, as stated above, are well known.

A variant of the traditional game of Blackjack is disclosed in Hall, U.S. Pat. No. 7,435,172, the disclosure of which is incorporated by reference, where if the dealer has a final hand value according to the rules of Blackjack of a selected value between 22-26, all remaining player hands, i.e. those who have not surrendered or busted, are pushed. This feature shifts the odds in favor of the dealer by converting what would have been a dealer loss to a push to offset a game rule set feature favoring the player(s).

Players as well as casinos and card clubs offering games often look for new games to recapture the excitement that may have been lost playing traditional Blackjack. For example, there are games that provide additional or different features for the game of Blackjack. However, in these games a consistent feature is that the players complete their hands based only upon the limited information of the dealer's up card. It is believed that a game based upon Blackjack and which provides additional information about the dealer's eventual final hand would instill excitement and new strategy considerations for play.

SUMMARY

There is, therefore, set forth according to the various embodiments of the present invention, a token collecting game based upon the well-known rules of Blackjack but which has the dealer completing their hand first with unrevealed, i.e. face down, cards. The number of cards required by the dealer to complete their hand gives players, in addition to the value of the dealer's up card, information about the number—but not the value(s)—of the cards required to complete the dealer's hand. The game can be played as a live game between live players and a dealer or as an electronic game played by one or more players on a gaming device.

One embodiment the invention is directed to a method for playing a token collecting game including features of Blackjack with physical playing cards between one or more physical players and a physical dealer. The game includes a card-reading device adapted to read the values of cards such as an electronic card delivering and reading shoe or shuffler. The method includes:

accepting from each player at a designated player position on a physical game layout a token to indicate participation by the player in the game, distributing an initial hand of physical playing cards to each participating player at their respective playing position, distributing and reading by the card reading device a hand of two cards to the dealer, at least one of the dealer's cards exposed face up, the card reading device issuing signals corresponding to the values of the cards of the dealer's hand, configuring a data processor in communication with the card reading device to receive the signals for (a) summing, according to Blackjack, the values of the cards of the dealer's hand, (b) determining, based upon the determined sum of the dealer's hand, if an additional card is required to complete the dealer's hand to a final hand value, (c) if an additional card is required generating a dealer perceptible signal and in response thereto (d) the dealer dealing face down and reading the additional card and summing according to Blackjack the value of all cards of the dealer's hand, and (d) repeating steps (b)-(d) until the dealer's hand is completed, for each player dealing none, one or more cards to complete each initial player hand to a player final hand value, exposing the cards of the dealer final hand and resolving the dealer final hand value against player final hand values, and awarding one or more tokens to a player when their final hand value is a winner versus the dealer final hand value.

Accordingly, the player(s), before taking none, one or more cards to complete their hands have the information of the dealer's up, exposed, card as well as the number of cards—but not their values—to complete the dealer's hand. In this regard, the dealer likewise does not know the values of the additional cards dealt face down to complete the dealer's hand.

Another aspect of the present invention is directed to an apparatus for facilitating the play of a token collecting game having features of Blackjack where: (1) a hand of two playing cards is dealt to each player and a hand of two cards is dealt to a dealer, (2) the dealer completes their hand with unrevealed cards to a dealer final hand before each Player complete their hands to final player according to the rules of Blackjack and (3) each player final hand is resolved against the dealer final hand. The apparatus includes;

a housing for holding an inventory of physical playing cards, the housing including a playing card dispensing chute, a card reader for reading the values of cards dispensed from the chute, a display for the dealer, a computer processor configured to receive signals from the card reader for (a) determining the values of the playing cards dealt to the dealer hand, (b) summing the values of the cards according to the rules of Blackjack and predetermined rules for completing the dealer hand, (c) determining, according to (b) whether an additional playing card is required to be dealt to the dealer hand and if so control the display to indicate the requirement for an additional card, (d) determining the value of the additional card dealt face down to the dealer hand, and (e) summing the value of the dealer's hand with the additional card and (f) repeating steps (b)-(d) until the dealer's hand is completed, whereby the dealer completes their hand to a dealer final with none, one or more undisclosed cards before each player completes their hand to a player final hand providing each player with information as to the number of cards required to complete the final dealer hand.

In a further embodiment a gaming device for playing a game based upon Blackjack is set forth where the dealer completes their hand first with a number of undisclosed playing cards giving the player information as to the number of cards—but not the values—to complete the dealer hand to a final dealer hand before a player complete theirs. The device includes;

a housing, one or more video displays supported at the housing, a processor, a player input device for the player to register an input to participate in the game and one or more inputs for completing a player hand to a player final hand, a data structure storing data to represent an inventory of playing cards and a rule set for the play of the game, the processor configured to; (i) receive the input by the player to participate in the game, (ii) from the data representing the inventory of playing cards and the rules of the game to select and control one or more video displays to display a hand of cards for a player hand and a dealer hand, (ii) sum the cards of the dealer hand according the game rule set data, (iii) if an additional card is required for the dealer hand to select and control one or more video displays to display the additional card face down, (iv) repeat (ii)-(iii) until the dealer's hand is completed to a final dealer hand according to the data of the rule set, after completion of the dealer's final hand, receiving at each participating player input device instructions to complete the player's hand to the player's final hand, and upon completion of each participating player's final hand, the processor configured to compare the dealer's final hand to each player's final hand and if, according to the rule set a player is entitled to an award, issue and display at the one or more video displays an award to the player.

The game can be played for fun as a token collecting game or on a "pay to play" basis such as in a casino setting or, where permitted, in an online setting.

As can be appreciated, the present invention provides a token collecting game based upon the familiar rules of Blackjack but which provides the player(s) with addition information about the dealer's hand. For example, a player seeing that the dealer up card is a "7" and will require five cards to compete their hand may surmise that the dealer will bust their hand leading to the player standing perhaps on a 13 or other less than optimal hand value.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular act in a method, apparatus, system, or component thereof, but are merely representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred generically without an alphabet character suffix.

The terms "game pieces" can be any physical or virtual item which can include playing cards used to exhibit the play, progress and result of the game. "Token" or "tokens" can be any physical or virtual item such as coins, chips, matchsticks, legal currency, play money candy or the like. Virtual tokens may refer to points, credits, and other items of value that may be purchased, earned, or otherwise issued prior to beginning the wagering game and may be collected as a result of a winning result. Virtual tokens may represent valueless points or credits as well.

For the purposes of this description, it will be understood that when an action related to accepting tokens, awarding tokens, distributing game pieces, making game play selections, or other actions associated with a player is described herein, and such description includes one or more players or competing players taking the action, the results of the action may be computer generated and may be displayed on a live or virtual table or electronic display, and, if applicable, the reception or detection of such an action in an electronic form where the participant choices, selections, or other actions are received at an electronic interface. This further includes the results of a virtual player, where the actions described are actually generated by a computer (typically associated with an online game). By way of a further example, if selecting game pieces is described herein, the description includes (but is not limited to) the following: the selection of game pieces from a supply of game pieces such as, for example, selecting and dealing of a playing card a deck, shuffler, shoe, or other card source and the reception or placement of the card at a table location associated with a participant; the generation and transmission of an electronic indication or representation of game pieces from a game play source or server to an electronic receiver, where the receiver may be at a game table (using virtual cards) including live or virtual participants, on a game play terminal, at a remote location (e.g., using online or Internet game play), or at other locations.

The Layout

Figure 1:
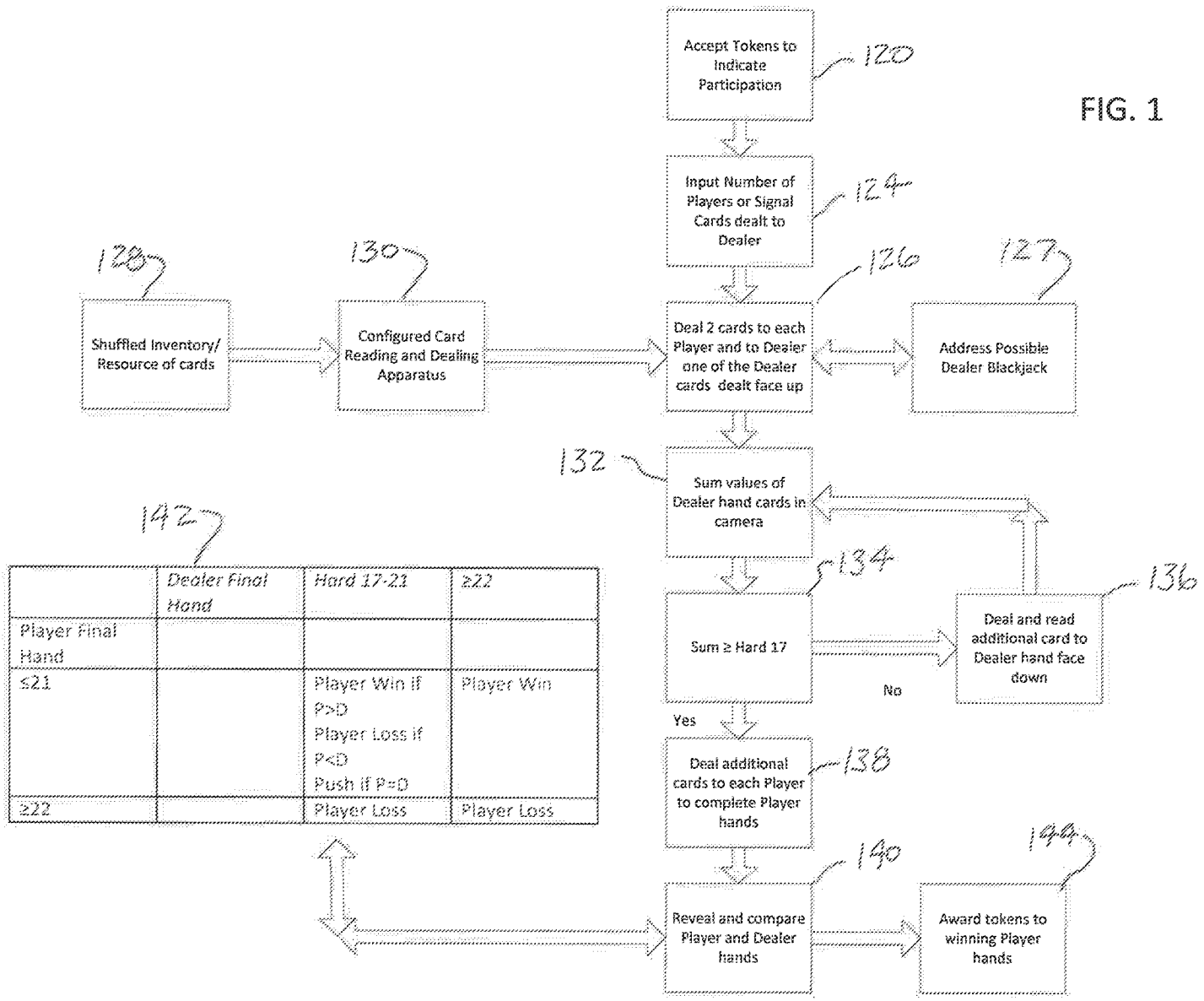
FIG. 1 is a flowchart diagram of a method of administering a game, according to an embodiment of this disclosure.
Figure 2:
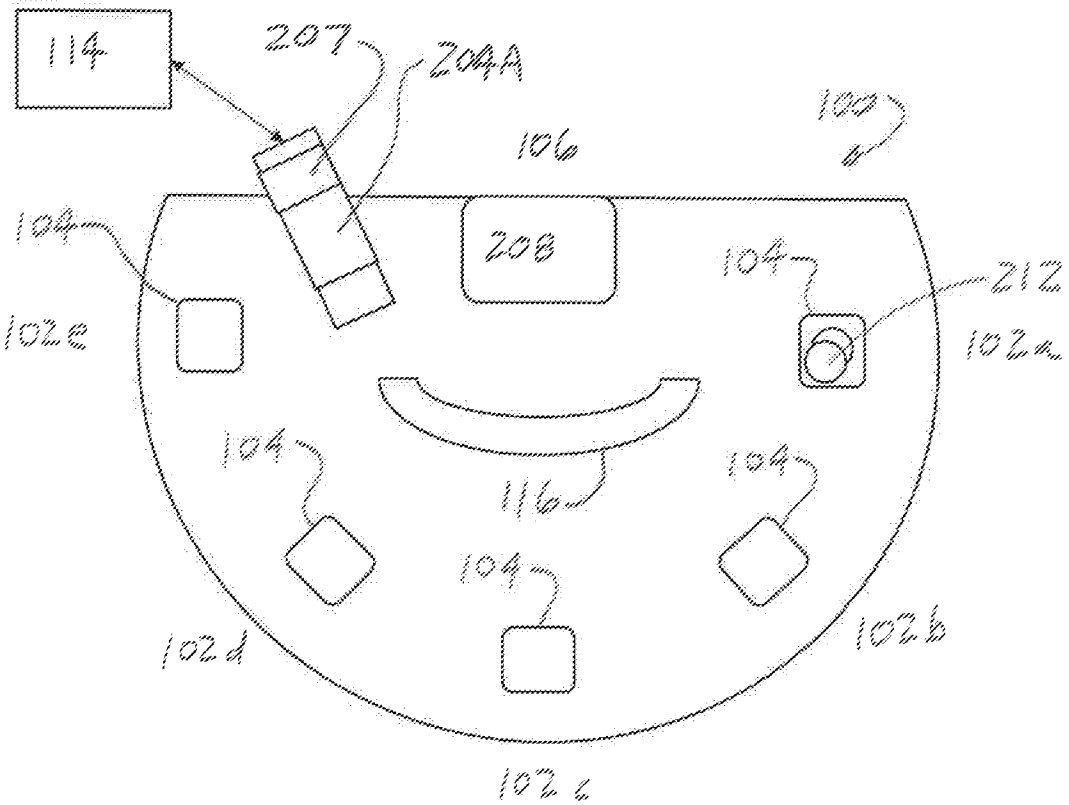
FIG. 2 illustrates a physical layout for the play of the token collecting game; example of game pieces such as playing cards for a round, i.e. hand, of play, according to an embodiment of this disclosure.
Figure 4:
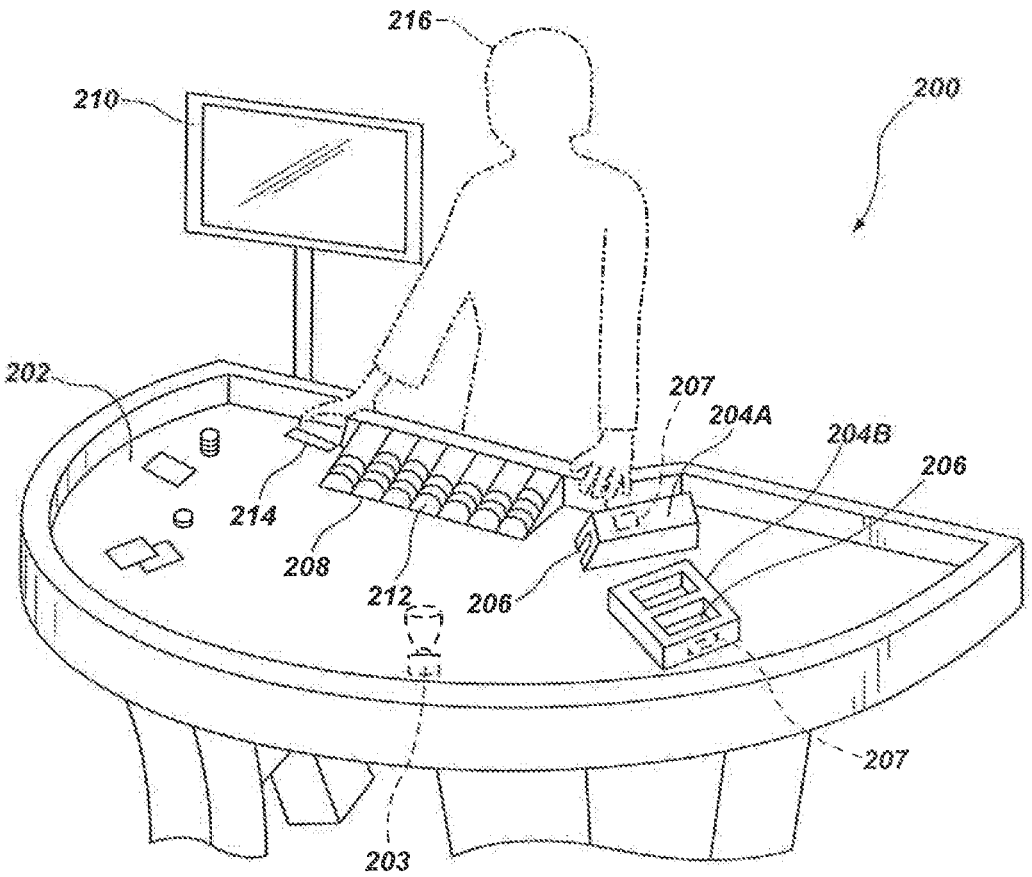
FIG. 4 is a perspective view of a gaming table configured for implementation of embodiments of wagering games in accordance with this disclosure.

Referring to FIGS. 1-2 a method for the play of a token collecting game is shown for play in a physical, live-play format. To control and confirm the actions taken during play of a round or hand of the game, the token collecting game includes a physical layout 100 positioned on a table 200 as described below. For example, the layout 100 may be a printed felt product covering the top of a table for hosting play by one or more players and a dealer. The layout 100 may denote several player locations 102*a-e* with a printed position marker 104 such as a logo or other marking. Opposite the player positions 102*a-e* is a dealer position 106 occupied by a physical, live dealer 216 (FIG. 4). At the dealer position 106 is a token or chip rack 208 to hold an inventory of tokens/chips for the play of the game. Also associated with the game is a card handling device 204A-B adapted for the distribution cards and reading of card values. The card handling device 204A-B is adapted to hold/supply from a randomized inventory of physical playing cards for play in a manner hereinafter described. The card handling device 204A-B may be a device as described in, for example, Downs, III, U.S. Pat. No. 8,150,158 titled "Unique Sensing System and Apparatus for Reading Playing Cards" issued Apr. 3, 2012, Hill, U.S. Pat. No. 6,582,301 issued Jun. 24, 2003 and titled "System Including Card Game Dispensing Shoe With Barrier, and Scanner, and Enhanced Card Gaming Table, Enabling Wagering By Remote Bettors", Grauzer et al, U.S. Pat. No. 9,370,710 issued Jun. 21, 2016 and titled "Methods for Shuffling Cards and Rack Assemblies For Use In Automatic Card Shufflers" and Krenn et al, U.S. Pat. No. 7,946,586 issued May 24, 2011 and titled "Swivel Mounted Card Handling Device", the disclosures of which are hereby incorporated by reference. In Snow, U.S. Pat. No. 9,761,080 issued Sep. 12, 2017 and titled "Commissionless Pai Gow With Dealer Qualification", the disclosure of which is incorporated by reference, there is disclosed a game using a card reader which reads the dealer's cards and a processor for determining dealer qualification and which includes a dealer control with a touch-screen display. As shown in FIG. 2, the card handling device 204A-B includes a dealer interface video display 207 which a touch-screen video display may be a touch screen video display. The card handling device 204A-B may additionally or alternatively includes a series of buttons and lights to provide information to the dealer and enable the dealer to input signals/information as hereinafter described. The card handling device 204A-B and video display 207 are in communication with a processor 114 whereby the card value data from the card handling device 204A-B is provided to the processor 114 and the processor 114 can provide control signals to the video display 207. In sum, the card handling device 204A-B is adapted to read at least the values of the cards dealt to the dealer's hand and provide that data to the processor 114. The processor 114 is programmed to receive the data from the card handling device 204A-B and based thereon issue instructions to the dealer at the video display 207. The processor 114 can be remote to the card handling device 204A-B or incorporated therein. The processing described herein may be shared between the card handling device 204A-B and processor 114.

For the game of Blackjack the layout 100 also includes an insurance banner 116 where players may place a token to participate in the insurance proposition in Blackjack which is well known in the game of Blackjack.

The Game

With reference to FIG. 1, the play of the token collecting game will now be described. At 120 a round or "hand" of play starts by accepting from each participating player one or more tokens 212 (FIG. 2) placed at or near the marker 104 for the participating player. By placing one or more tokens 212 the dealer and, in a casino setting, security can confirm participation in the game and the number of tokens 212 placed by each player. To be able to determine the value of the dealer's hand according to the present invention it must be determined which cards are dealt to the dealer hand. In one embodiment, this information may be by the dealer at 124 inputting at the video display 207 the number of players participating in the game. In an alternate embodiment, the dealer may enter an input at the video display 207 in advance of the cards dealt to the dealer hand. For example, where the dealer inputs the number of participating players at the video display 207, the card handling device 204A-B and/or processor 114 receives signals to discriminate from the card reading signals for the cards dealt to the dealer's hand. For example, in Blackjack, two cards are initially dealt to each player and the dealer—with the cards dealt in sequence around the table, i.e. a first card to each player around the table and then to the dealer and then the second card dealt to each player in sequence and then the dealer. Typically, in Blackjack, the last card dealt to the initial two-card dealer hand is turned over and exposed to the players whereas the first card remains face down and unexposed to the players. In an example where there are three players, every fourth card dealt would be for the dealer hand and would be processed according to the present invention. Thus where N is the number of participating players, the card handling device 204A-B/processor 114 would be configured to read every N+1 cards as being the cards to the initial deal dealt to the dealer. It should be noted that the card handling device 204A-B and processor 114 may be configured to read the player's cards as well for various purposes such as detecting cheating, skill level, table performance or the like. As will become evident, according to the present invention the card handling device 204A-B/processor 114 must read the cards of the dealer hand without disclosing the values of the dealer's face down cards to either the dealer or the players.

In another embodiment, the dealer may enter an input at the video display 207 in advance or subsequent to a card(s) being dealt to the dealer hand to signal the card handling device 204A-B/processor 114 to read the card(s) or process the card data as relating to cards for the dealer hand.

Continuing with FIG. 1, at 126 two cards are dealt to each participating player hand and to the dealer hand, with one card of the dealer hand turned face-up and the other face down. The cards are dealt from a shuffled inventory of cards 128 such as one or more shuffled decks placed in or resourced from the card handling device 204A-B from a shuffling device. At 130 at least the cards dealt to the dealer hand are read by the card reader and that data is processed at the card handling device 204A-B or processor 114 or between them for, as described below, determining the values of the cards of the dealer hand according to the rules of Blackjack. According to those rules, for example, an Ace can represent either a "1" or an "11". Based upon the initial deal of two cards to each participating player and the dealer the traditional rules of Blackjack initially apply to the play. For example, the dealer may have a Blackjack (Ace+10-value card) resulting in an automatic loss to players who did not take insurance or had a Blackjack themselves. If the dealer does not have an initial two-card Blackjack and a player does, the player's initial two-card hand is an automatic winner resulting in an award of tokens to the player. Again, these rules are traditional. The card handling device 204A-B and processor 114 may be configured to send a signal to the dealer interface 112 to notify the dealer that he/she has an exposed Ace and the face down card is a 10-value card, i.e. a Blackjack, based upon reading of the cards dealt to the dealer hand. Alternatively, as in traditional Blackjack, if the dealer exposed card is an Ace, at 127 the play by the dealer may proceed as in traditional Blackjack—if the exposed card is an Ace the dealer may signal that insurance is available to the players and after the player have opted to place one or more tokens at the insurance banner 116, check the face down ("hole") card by known means such as a hole card peek device, to determine if indeed the dealer has an initial Blackjack. If the dealer does not have a Blackjack, and tokens placed for insurance are collected and any player having a Blackjack from their initial two-card hand will receive an award and for that/those players the round is concluded. These rules are known for traditional Blackjack.

In the event the dealer does not have a Blackjack, the process at 132 includes the card handling device 204A-B and/or processor 114, from the data representing the read values of the dealer's first two cards at 132, sums the value of the cards according to the card valuation rules of Blackjack to determine if the dealer's hand will require an additional card. The determined sum is not disclosed to the dealer or the players. Under the rules of traditional Blackjack and based upon the specific rules for completing the dealer's hand, i.e. "house" rules, if the dealer's first two cards have a sum of less than a hard 17, the dealer will require one or more additional cards. By a hard "17" what is meant is that the initial two-card "17" does not include an Ace. For example, if the dealer's first two cards are Ace+6, that is a "soft 17" since the Ace can be a "1" or an "11". In this instance, according to many prevailing game rules, the dealer will require one or more cards to complete their hand. If, instead, the dealer's first two cards are King+7, that is a "hard 17" and the dealer's hand does not require any additional cards and has a final value of "17". The dealer's hand does not require additional cards if the initial two cards have a sum of 18-20 as well.

At 134 the card handling device 204A-B and/or processor 114 determines if the dealer's hand requires an additional card, i.e. the cards have a summed value greater than or equal to a hard 17. If this condition exists, the card handling device 204A-B/processor 114 may be configured such that they receive the card reader data for the next one or more cards as going to the dealer hand. Additionally or alternatively, the dealer may confirm at the video display 207 that the next card drawn from the card handling device 204A-B is destined for the dealer's hand. For example, if the dealer's first two cards are an 8+7 equaling a sum of 15, the condition for a final dealer hand is not satisfied and at 136 the card handling device 204A-B/processor 114 sends a signal to the video display 207 that the dealer is to draw an additional card from the card handling device 204A-B (face down and unexposed to the players) for the dealer hand. As a significant departure from the game of Blackjack, the dealer "goes first" to complete his/her hand with cards dealt face down, unexposed and unrevealed to the players and the dealer. The video display 207 is controlled to provide a signal to the dealer that an additional card is required without disclosing the summed values of the initial two cards, the value of the dealt additional card or the new sum of the dealer's hand including the additional card(s). The signal may be a light or other visual cue to the dealer. The dealt card is placed face down with the dealer's initial cards on the layout 100. The card reader of the card handling device 204A-B reads the value of the additional card and provides a corresponding signal whereby at 132 all cards of the dealer's hand are summed. If at 134 the value of the dealer's hand with the additional card does not satisfy the condition of being greater than or equal to a hard 17, at 134 a signal is again generated for the dealer to draw a second additional card and place it face down on the layout 100. The process continues until the dealer final hand value of greater than or equal to a hard 17 is satisfied.

When the condition at 134 is satisfied either a signal is sent to the video display 207 that the hand is complete or no further "draw an additional card" signals are sent to and displayed at the dealer interface 112, whereby the dealer can conclude that no additional cards are required for the final dealer hand.

There are several features worth noting. As stated above the dealing of any additional cards to the dealer's hand is completed first (but unrevealed) before the players have to act on their hands. The additional cards are dealt to the dealer hand face down and the values of at least the face down additional cards and the final value of the dealer's hand are unknown to the players or the dealer. In situations where the dealer's exposed card is an Ace, in determining whether the dealer has a Blackjack, requires the dealer to know the value of the face down card of his/her initial two-card hand. Alternatively, the card handling device 204A-B/processor 114 where the dealer has an exposed Ace in the initial two-card dealer hand may simply send a signal where the dealer indeed has a Blackjack. In this embodiment, in situations where the dealer does not have a Blackjack the dealer would not know the value of the face down card of the initial dealer card as well.

After the dealer's hand is completed, at 138 the action turns to the players to complete their hands according to the rules of the game, e.g. traditional Blackjack. In deciding whether to request additional cards the players have the information from the exposed card in the dealer's hand as well as the number of cards—but not their values—required to complete the dealer's hand. For example, if the dealer has an exposed "8" and requires three additional cards to complete the hand to a final dealer hand a player my surmise that the dealer has busted. If a player busts their hand, i.e. a final value of 22 or greater, according to the rules of traditional Blackjack, they automatically lose and their token(s) is/are collected regardless of the value of the dealer final hand—even if the dealer has busted his/her hand as well. If the dealer's exposed card is, for example, a "7" and the dealer does not take any additional cards the players know that the dealer hand is either 17 or 18 (the hole card could be a ten-value card or an Ace). After all players have completed their hands, at 140 the cards of the dealer hand and the players hands are revealed, compared and settled against a set of rules. At 142 is a table showing an example of a rule set conditions for various outcomes. As indicated in the table 142 if the player and dealer final hands are less than or equal to 21 and the player "P" final hand has a value greater than the dealer "D" the player wins their hand and at 144 is issued an award at 144 of, for example, additional token(s). If the dealer hand has a higher value the player loses their hand and their token(s) are collected by the dealer. If the player and dealer hand tie it is a push and the player neither wins nor loses. If the dealer's final hand is 22 or more and the player did not previously bust their hand, the player wins and at 144 is issued an award at 144 of, for example, additional token(s).

Inasmuch as the feature of the dealer completing their hand first as described above may alter the payback percentage to be more favorable to the players from traditional Blackjack, a Push 22 mechanic as described in Hall, U.S. Pat. No. 7,435,172 (the disclosure of which has been incorporated by reference) may be included. If included, as reflected in the table below, the data for the table 142 of the rules would be altered to reflect the rule that if the player final hand is less than or equal to 21 and the dealer's final hand is 22, the player's hand which would have been winners under the rules of traditional Blackjack, would be declared pushes. If the dealer's final hand is greater than or equal to 23, the player wins. Other odds-altering mechanics may be used to offset the pay back percentage provided by the feature of the dealer completing their hand first.

| | Dealer Final Hand | | |
|---|---|---|---|
| Player Final Hand | Hard 17-21 | 22 | ≥23 |
| ≤21 | Player Win if P > D<br>Player Loss if P < D<br>Push if P = D | Player Push | Player Win |
| ≥22 | Player Loss | Player Loss | Player Loss |

Various platforms are contemplated that are suitable for implementation of embodiments of token collection games according to this disclosure. For example, embodiments of token collecting games may be implemented as live table games with live participants at designated locations at the table, electronic gaming machines, partially or fully automated table games, and partially or fully automated, network-administered games (e.g., Internet games) wherein game results may be produced utilizing a processor or a live video feed of a dealer administering a game from a remote studio.

As previously noted, any of the present methods and games may be played as a live game, as a hybrid table game (with virtual game pieces or virtual tokens), on a multi-participant electronic platform (such as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer or mobile device for fun or practice or on the Internet.

For example, in one embodiment, the players may be remotely located from a live dealer and a live dealer and a table may be displayed to players on their monitors via a video feed. The players' video feeds may be transmitted to the dealer and may also be shared among the players at the table. In a sample embodiment, a central station may include a plurality of input devices and an electronic camera for each game device. A plurality of player stations, remotely located with respect to the central station, may each include a monitor, for displaying a selected game device at the central station, and input means, for selecting a game device and for placing a of a virtual token by a player at the player's station. Further details on systems and methods for remotely located players are disclosed in U.S. Pat. No. 6,755,741 B1, issued Jun. 29, 2004, titled "Gambling Game System and Method for Remotely-Located Players," the disclosure of which is incorporated herein in its entirety by this reference.

In some embodiments, the games described herein may be played against a game administrator (i.e., against "the house" such that the game is "house-banked"). Such implementations may involve the game administrator (e.g., a casino or other gaming establishment) accepting (e.g., via a dealer or other agent of the administrator) tokens, distributing awards to players, and collecting tokens from losing players. Such "house-banked" embodiments may be implemented, for example, in the form of a live table game, in a virtual table game, in an electronic game, or in a networked (e.g., Internet) game configuration.

FIG. 4 is a perspective view of an embodiment of a table 200 for implementing the games in accordance with this disclosure. The table 200 may be a physical article of furniture around which players may stand or sit and on which the physical objects used for administering and otherwise participating in the wagering game may be supported, positioned, moved, transferred, and otherwise manipulated. For example, the table 200 may include a surface 202 supporting the layout 100 on which the physical objects used in administering the game may be located. As a specific, non-limiting example, the layout 100 may be configured as shown in FIG. 2.

In some embodiments, the table 200 may include a display 210 separate from the surface 202. The display 210 may be configured to face players, prospective players, and spectators and may display, for example, rules, pay tables, real-time game status, such as tokens accepted and cards dealt, historical information, such as percentage of hands won, and notable hands achieved and other instructions and information related to the game. The display 210 may be a physically fixed display, such as a poster, in some embodiments. In other embodiments, the display 210 may change automatically in response to a stimulus (e.g., may be an electronic video monitor).

The table 200 may include particular machines and apparatuses configured to facilitate the administration of the game. For example, the table 200 may include one or more of the card-handling devices 204A-B. The card-handling device 204A may be, for example, a shoe from which physical cards 206 from one or more decks of playing cards may be withdrawn and read one at a time. Such a card-handling device 204A may include, for example, a housing in which cards 206 are located, an opening from which cards 206 are removed, and a card-presenting mechanism (e.g., a moving weight on a ramp configured to push a stack of cards down the ramp) configured to continually present new cards 206 for withdrawal from the shoe. Additional details of an illustrative card-handling device 204A configured as a shoe are found in U.S. Patent App. Pub. No. 2010/0038849, published Feb. 18, 2010, and titled "INTELLIGENT AUTOMATIC SHOE AND CARTRIDGE," the disclosure of which is incorporated herein in its entirety by this reference, as well the devices described above.

The card-handling device 204B may be, for example, a shuffler configured to reorder physical cards 206 from one or more decks of playing cards and present randomized cards 206 for use in the wagering game. Such a card-handling device 204B may include, for example and in addition to those described above, a housing, a shuffling mechanism configured to shuffle cards, and card inputs and outputs (e.g., trays). Additional details of an illustrative card-handling device 204B configured as a shuffler are found in U.S. Pat. No. 8,070,574, issued Dec. 6, 2011, to Grauzer et al., the disclosure of which is incorporated herein in its entirety by this reference. Shufflers such as the devices disclosed in the '574 Patent may include card recognition capability and may form randomly ordered hands of a known composition within the shuffler. Additionally, game rules may also be programmed within the card handling device 204A-B/processor 114 as described above. The card-handling device 204A-B may also be, for example, a combination shuffler and shoe in which the output for the shuffler is a shoe.

In some embodiments, the card-handling device 204A-B may be configured and programmed to administer at least a portion of a game being played utilizing the card-handling device 204. For example, the card-handling device 204A-B may be programmed and configured to randomize a set of cards and present one or more cards for use according to game rules. More specifically, the card-handling device 204 may be programmed and configured to, for example, randomize a set of cards including one or more 52-card decks of standard playing cards. The touch screen enabled video display 207 is adapted to accept dealer input such as, for example, the number of players or input to inform the card handling device 204A-B of the number of players for a round of the game and which cards are destined for the dealer's hand as described above. The game rules may be programmed into the memory of the card handling device 204A-B and/or processor 114.

The card-handling device 204 may simply be supported on the gaming surface 202 in some embodiments. In other embodiments, the card-handling device 204 may be mounted into the gaming table 202 such that the card-handling device 204 is not manually removable from the gaming table 202 without the use of tools. In some embodiments, the deck or decks of playing cards used may be standard, 52-card decks. The shuffler may also be configured to handle and dispense security cards, such as cut cards.

In some embodiments, the card-handling device 204 may include the electronic display 207 for displaying information related to the game being administered such as the information described above. For example, the electronic display 207 may also display a menu of game options, acceptable amounts for wagers (e.g., maximums and minimums), numbers of cards to be dealt to recipients, locations of particular recipients for particular cards, winning and losing wagers, pay tables, winning hands, losing hands, and payout amounts. In other embodiments, information related to the wagering game may be displayed on another electronic display, such as, for example, an interactive button panel.

The type of card-handling device 204 employed to administer embodiments of the disclosed wagering game, as well as the type of card deck employed and the number of decks, may be specific the game to be implemented. Cards used in games of this disclosure may be, for example, standard playing cards from one or more decks, each deck having cards of four suits (clubs, hearts, diamonds, and spades) and of rankings ace, king, queen, jack, and ten through two in descending order. As a more specific example, six, seven, or eight standard decks of such cards may be intermixed. Typically, six or eight decks of 52 standard playing cards each may be intermixed and formed into a shuffled inventory or resource for cards. A suitable device employing random number generation for card management and randomization is marketed under the name MD3® by Bally Gaming, Inc. of Las Vegas, Nev. Aspects of this device are described in U.S. Pat. No. 8,579,289, issued Nov. 12, 2013, to Rynda et al., and the shuffling mechanism is fully described in U.S. Pat. No. 7,677,565, issued Mar. 16, 2010, to Grauzer et al., the disclosure of each of which is incorporated herein in its entirety by this reference. After shuffling, the randomized inventory may be transferred into another portion of the card-handling device 204B or another card-handling device 204A altogether, such as a mechanized shoe capable of reading at least card value (rank) and perhaps also suit. More specifically, the shoe disclosed in, for example, U.S. Pat. No. 8,511,684, issued Aug. 20, 2013, to Grauzer et al., the disclosure of which is incorporated herein in its entirety by this reference, might be used to automatically dispense one or more cards at a time from the randomized inventory.

The gaming table 200 may include a chip rack 208 configured to facilitate accepting tokens and exchanging monetary value for tokens 212 (e.g., chips). For example, the chip rack 208 may include a series of token support rows, each of which may support tokens of a different type (e.g., color and denomination). In some embodiments, the chip rack 208 may be configured to automatically present a selected number of chips using a chip-cutting-and-delivery mechanism. Additional details of an illustrative chip rack 208 and chip-cutting-and-delivery mechanism are found in U.S. Pat. No. 7,934,980, issued May 3, 2011, to Blaha et al., the disclosure of which is incorporated herein in its entirety by this reference. In some embodiments, the gaming table 200 may include a drop box 214 for money that is accepted in exchange for wagering elements 212. The drop box 214 may be, for example, a secure container (e.g., a safe or lockbox) having a one-way opening into which money may be inserted and a secure, lockable opening from which money may be retrieved. Such drop boxes 214 are known in the art, and may be incorporated directly into the gaming table 200 and may, in some embodiments, have a removable container for the retrieval of money in a separate, secure location.

Figure 5:
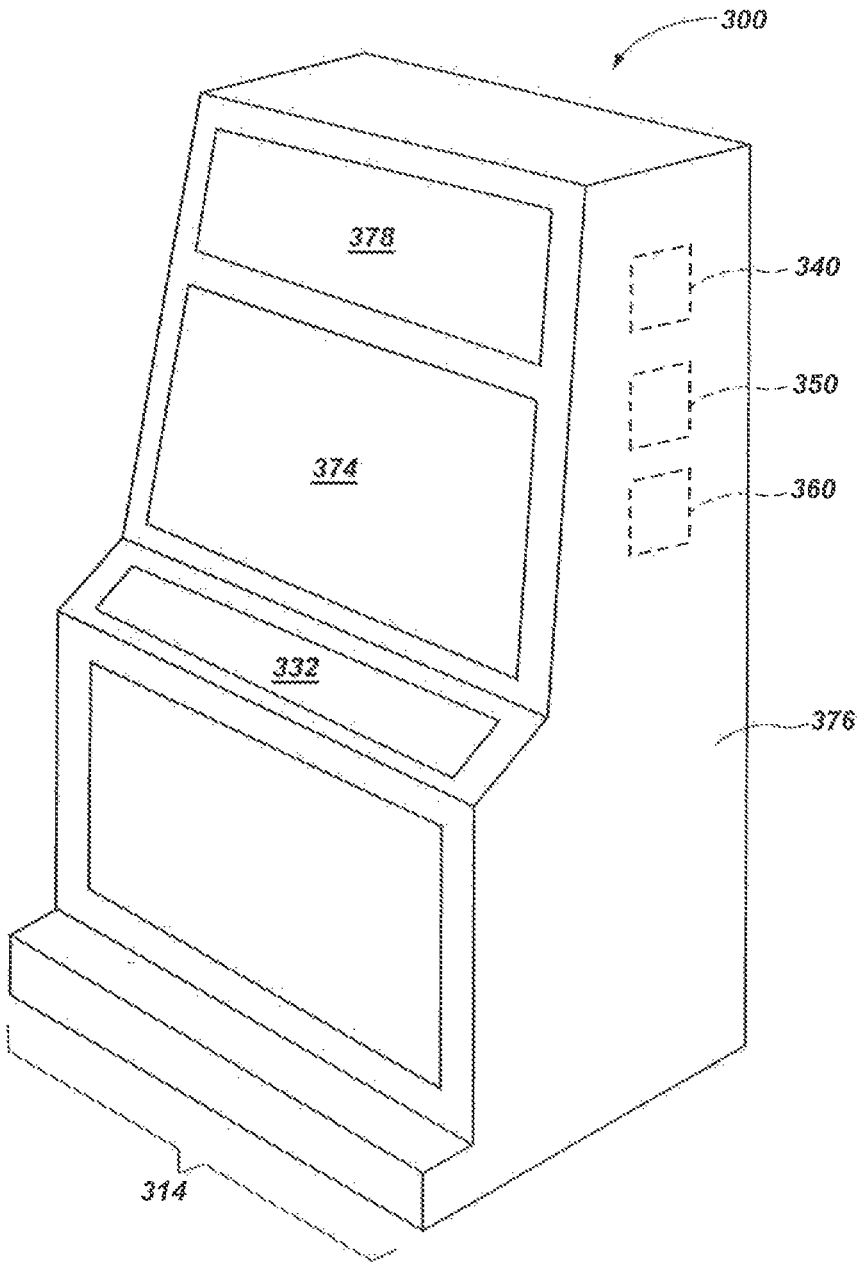
FIG. 5 is a perspective view of an individual electronic gaming device configured for implementation of embodiments of wagering games in accordance with this disclosure.

FIG. 5 is a perspective view of an individual electronic gaming device 300 (e.g., an electronic gaming machine (EGM)) configured for implementing the games according to this disclosure. The individual electronic gaming device 300 may include an individual player position 314 including a player input area 332 configured to enable a player to interact with the individual electronic gaming device 300 through various input devices (e.g., buttons, levers, touch-screens). The individual electronic gaming device 300 may include a gaming video display 374 configured to display indicia for interacting with the individual electronic gaming device 300, such as through processing one or more programs stored in memory 340 to implement the rules of game play at the individual electronic gaming device 300. Accordingly, game play may be played without physical playing cards or tokens and without a live dealer. The action may instead be simulated by a control processor 350 operably coupled to the memory 340 and interacting with and controlling the individual electronic gaming device 300.

Figure 3:
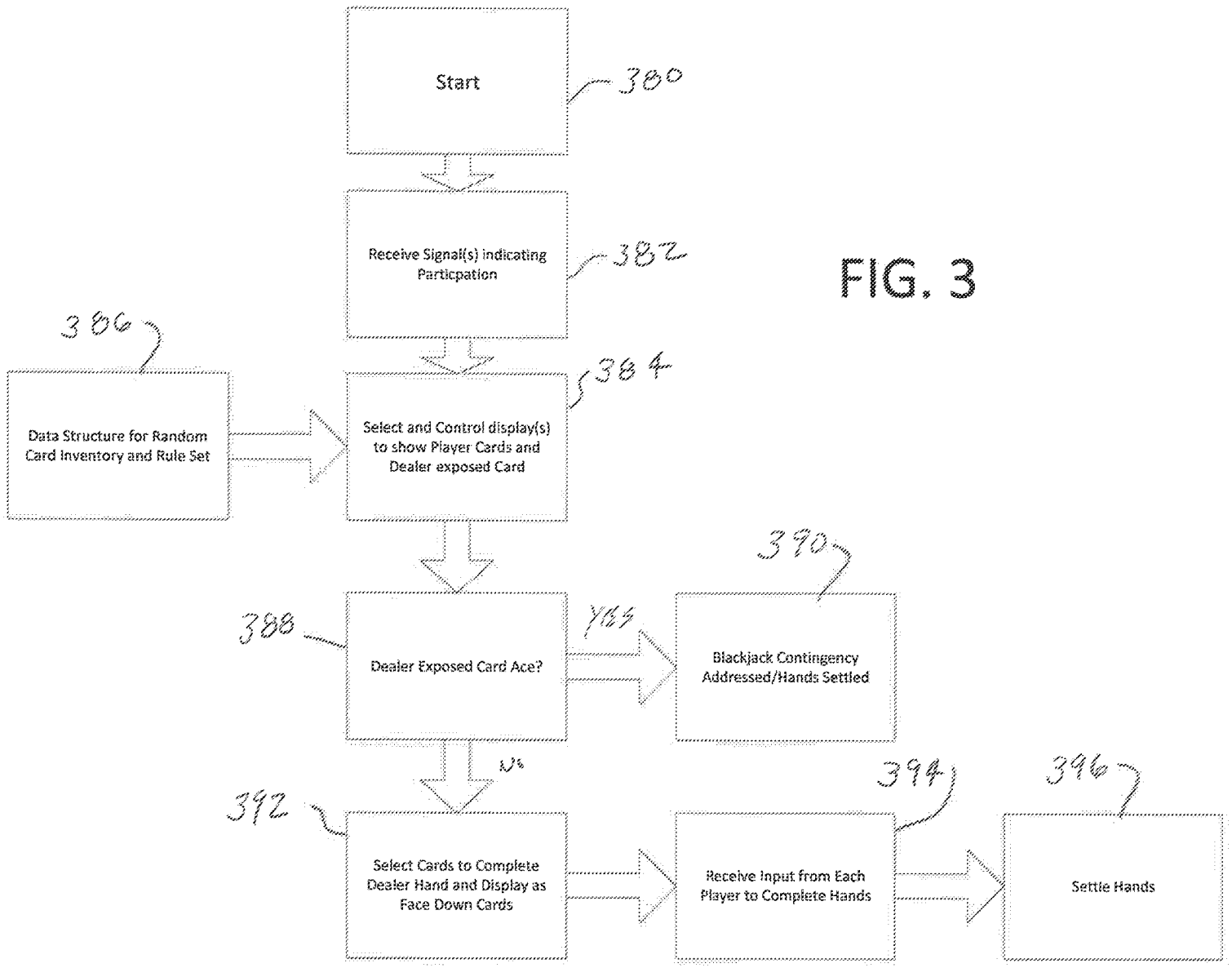
FIG. 3 is a flowchart for a processor for administering the game in an electronic format.

FIG. 3 illustrates the operation of the processor 350 and memory 340 for play. In this embodiment the memory 340 may store and/or provide processor 350 instructions to access data representing the rules of the game as well as data representing virtual playing cards. At 380 the process starts and at 382 the processor 350 receives player input from the player input area 332 indicating participation in a hand or round of the game. This input may be registration or one or more virtual tokens, e.g. credits for play and prompting play of the game. The processor 350 at 384 selects from a data structure 386 representing a randomized inventory at least one deck of virtual playing cards and displays at the display 374 cards for the initial player and dealer hands. As described above the dealer's hand will have the value of one card exposed to the player with the other displayed face down. The player's cards are dealt face up. If, at 388, the dealer's exposed card is an Ace at 390 the processor 350 will determine if the dealer has a Blackjack and if so either resolve the game by resolving the player's hand as a loss and virtually collecting the player's virtual token(s), or if the player also has a Blackjack resolving the game as a push for the player or, according to some rules, issuing an award to the player. At 390 the processor 350 may be configured by software in the memory 340 to enable the player to register one or more virtual tokens to indicate participation in an insurance feature where the dealer's exposed card is an Ace. Id the dealer does have a Blackjack the processor 350 is instructed to issue an award as one or more virtual tokens or credits based upon the participation in the insurance feature.

If the dealer does not have an exposed Ace in the initial, displayed, two-card dealer hand, at 392 the processor 350 is configured to select and display at the display 374 face down the cards required to complete the final dealer hand as described above. After the selection and display of any additional cards for the dealer hand at 394 the processor 350 receives input from the player to complete the player's hand. As described above this input may be instructions that the player stands on their initial hand whereby the player's initial becomes his/her final hand, split their hand, double down and prompt the selection and display of one or more additional cards to complete the player's hand. After the player has busted or stands on their final hand(s), at 396 the hands are settled by the player losing their virtual tokens or winning an award according to the rules described above.

Although the individual electronic gaming device 300 displayed in FIG. 5 has an outline of a traditional gaming cabinet, the individual electronic gaming device 300 may be implemented in other ways, such as, for example, client software downloaded to a portable device, such as a smart phone, tablet, or laptop computer. The individual electronic gaming device 300 may also be a non-portable personal computer (e.g., a desktop or all-in-one computer) or other computing device. In some embodiments, client software is not downloaded but is native to the device or is otherwise delivered with the device when distributed.

A communication device 360 may be included and operably coupled to the processor 350 such that information related to operation of the individual electronic gaming device 300, information related to the game play, or combinations thereof may be communicated between the individual electronic gaming device 300 and other devices, such as a server, through a suitable communication medium, such, as, for example, wired networks, Wi-Fi networks, and cellular communication networks.

The display 374 may be carried by a generally vertically extending cabinet 376 of the individual electronic gaming device 300. The individual electronic gaming device 300 may further include banners to communicate rules of game play and the like, such as along a top portion 378 of the cabinet 376 of the individual electronic gaming device 300. The individual electronic gaming device 300 may further include additional decorative lights (not shown), and speakers (not shown) for transmitting and optionally receiving sounds during game play. Further detail of an example of an individual electronic gaming device 300 (as well as other embodiments of tables and devices) is disclosed in U.S. patent application Ser. No. 13/963,165, filed Aug. 9, 2013, and titled "METHODS AND SYSTEMS FOR ELECTRONIC GAMING," the disclosure of which is incorporated herein in its entirety by this reference.

Some embodiments may be implemented at locations including a plurality of player stations. Such player stations may include an electronic display screen for display of game information (e.g., cards, wagers, and game instructions) and for accepting wagers and facilitating credit balance adjustments. Such player stations may, optionally, be integrated in a table format, may be distributed throughout a casino or other gaming site, or may include both grouped and distributed player stations.

Figure 6:
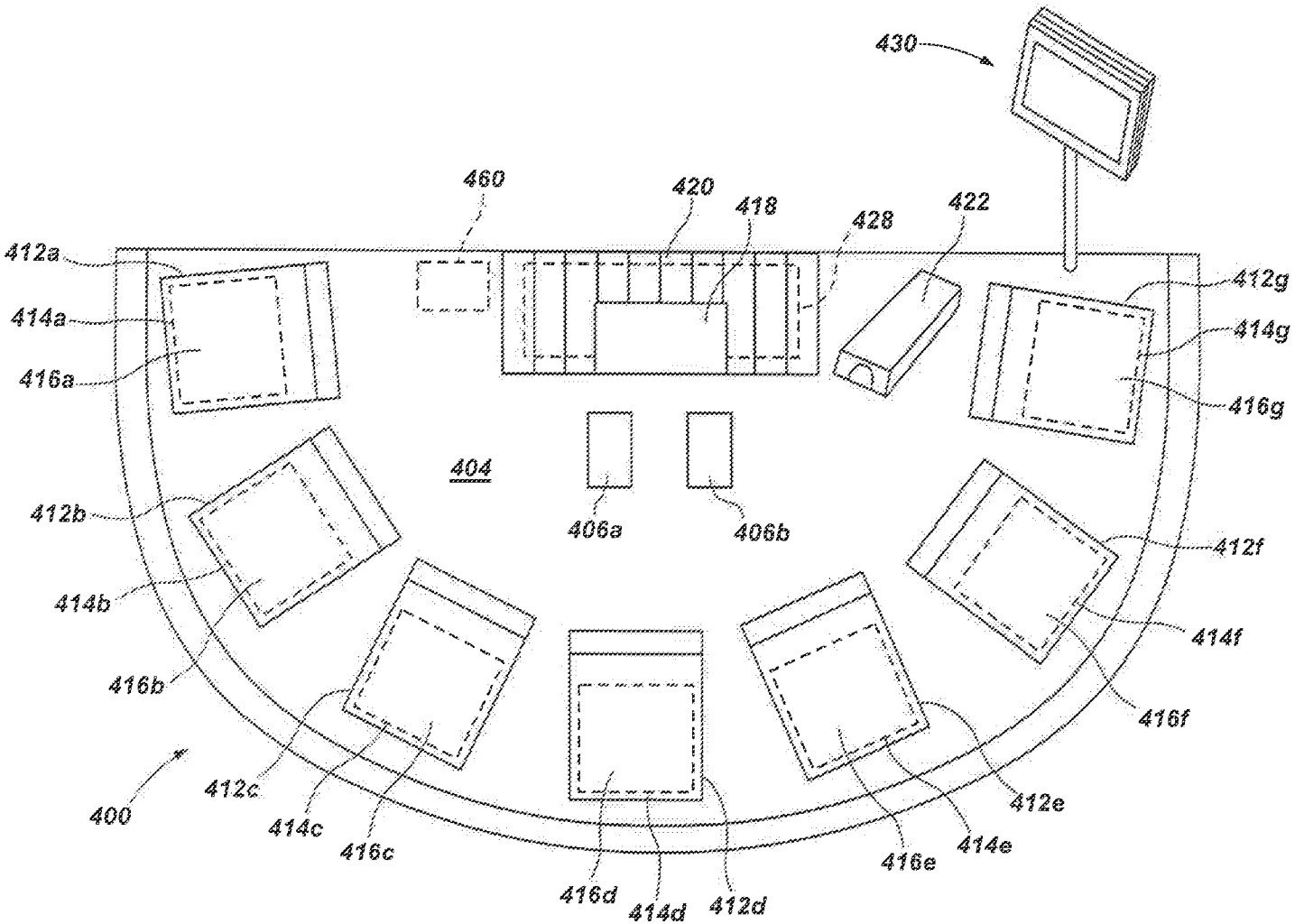
FIG. 6 is a top view of a table configured for implementation of embodiments of wagering games in accordance with this disclosure.

FIG. 6 is a top view of a suitable table 400 configured for implementing the games according to this disclosure. The table 400 may include a playing surface 404. The table 400 may include player stations 412. Each player station 412 may include a player interface 416, which may be used for displaying game information (e.g., game instructions, input options, wager information, game outcomes, etc.) and accepting player input. The player interface 416 may be a display screen in the form of a touch screen, which may be at least substantially flush with the playing surface 404 in some embodiments. Each player interface 416 may be operated by its own local game processor 414 (shown in dashed lines), although, in some embodiments, a central game processor 428 (shown in dashed lines) may be employed and may communicate directly with player interfaces 416. In some embodiments, a combination of individual local game processors 414 and the central game processor 428 may be employed. Each of the processors 414 and 428 may be operably coupled to memory including one or more programs related to the rules of game play at the table 400.

A communication device 460 may be included and may be operably coupled to one or more of the local game processors 414, the central game processor 428, or combinations thereof, such that information related to operation of the table 400, information related to the game play, or combinations thereof may be communicated between the table 400 and other devices through a suitable communication medium, such as, for example, wired networks, Wi-Fi networks, and cellular communication networks.

The table 400 may further include additional features, such as a dealer chip tray 420. For embodiments using physical cards 406*a* and 406*b*, the table 400 may further include a card-handling device 422, which may be configured to shuffle, read, and deliver physical cards for the dealer and players to use during game play or, alternatively, a card shoe configured to read and deliver cards that have already been randomized. For embodiments using virtual cards, the virtual cards may be displayed at the individual player interfaces 416.

The table 400 may further include a dealer interface 418, which, like the player interfaces 416, may include touch screen controls for receiving dealer inputs and assisting the dealer in administering the game. The table 400 may further include an upright display 430 configured to display images that depict game information such as pay tables, hand counts, historical win/loss information by player, and a wide variety of other information considered useful to the players. The upright display 430 may be double sided to provide such information to players as well as to casino personnel.

Further detail of an example of a table and player displays is disclosed in U.S. Pat. No. 8,262,475, issued Sep. 11, 2012, and titled "CHIPLESS TABLE SPLIT SCREEN FEATURE," the disclosure of which is incorporated herein in its entirety by this reference. Although an embodiment is described showing individual discrete player stations, in some embodiments, the entire playing surface 404 may be an electronic display that is logically partitioned to permit game play from a plurality of players for receiving inputs from, and displaying game information to, the players, the dealer, or both.

Figure 7:
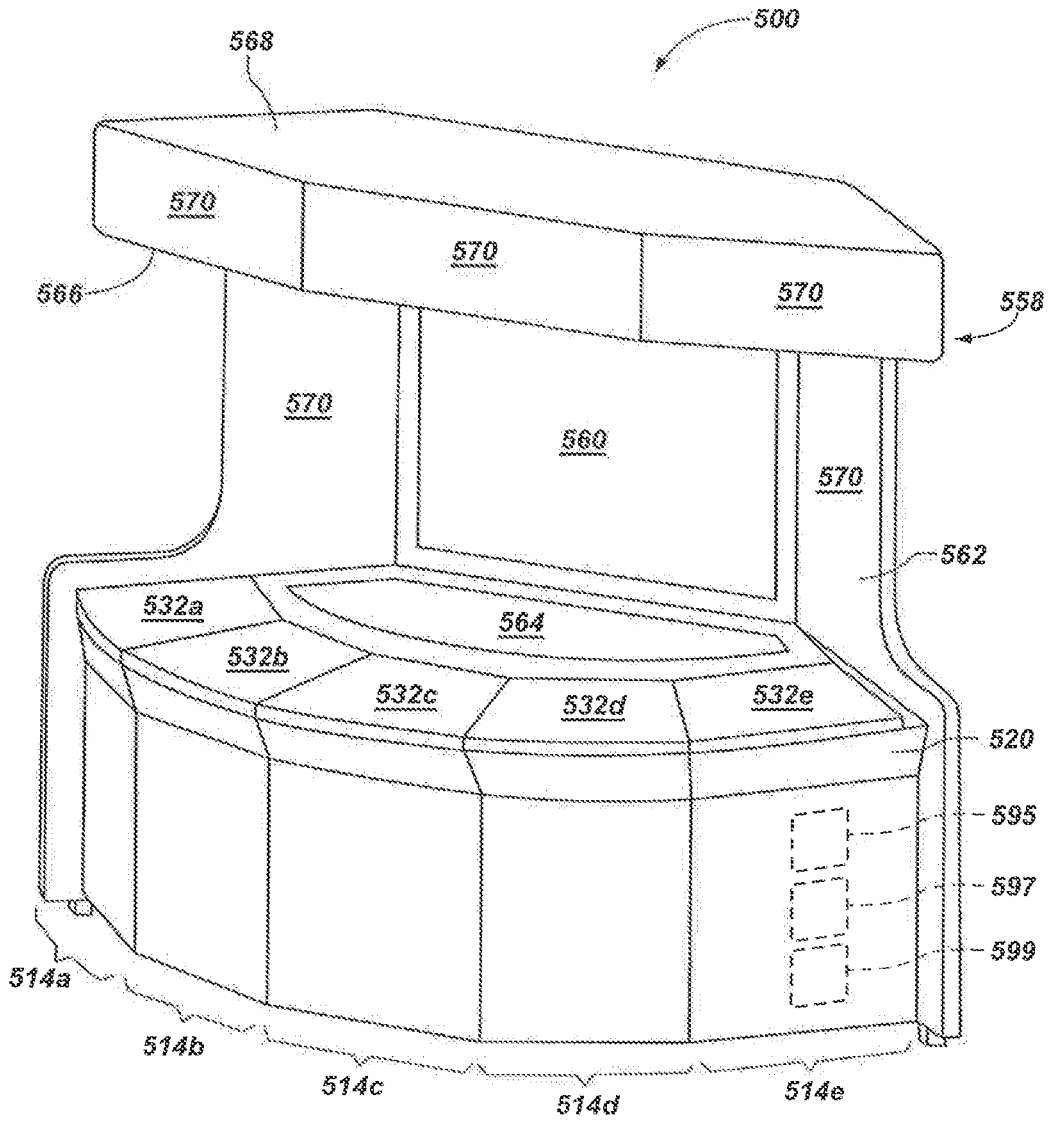
FIG. 7 is a perspective view of another embodiment of a table configured for implementation of embodiments of wagering games in accordance with this disclosure, wherein the implementation includes a virtual dealer.

FIG. 7 is a perspective view of another embodiment of a suitable table 500 configured for implementing games according to the present disclosure utilizing a virtual dealer. The table 500 may include player positions 514 arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the dealer's cards, any community cards, and player's cards by the virtual dealer on the dealer screen 560.

Each of the player positions 514 may include a player interface area 532 configured for wagering and game play interactions with the video device 558 and virtual dealer. Accordingly, game play may be accommodated without involving physical playing cards, poker chips, and live personnel. The action may instead be simulated by a control processor 597 interacting with and controlling the video device 558. The control processor 597 may be programmed, by known techniques, to implement the rules of game play at the video device 558 such as suggested at FIG. 3. As such, the control processor 597 may interact and communicate with display/input interfaces and data entry inputs for each player interface area 532 of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices, such as a central server, through a suitable communication medium, such, as, for example, wired networks, Wi-Fi networks, and cellular communication networks.

The video device 558 may further include banners communicating rules of play and the like, which may be located along one or more walls 570 of the cabinet 562. The video device 558 may further include additional decorative lights and speakers, which may be located on an underside surface 566, for example, of a generally horizontally extending top 568 of the cabinet 562 of the video device 558 generally extending toward the player positions 514.

Further detail of an example of a table and player displays is disclosed in U.S. Pat. No. 8,272,958, issued Sep. 25, 2012, and titled "AUTOMATED MULTIPLAYER GAME TABLE WITH UNIQUE IMAGE FEED OF DEALER," the disclosure of which is incorporated herein in its entirety by this reference. Although an embodiment is described showing individual discrete player stations, in some embodiments, the entire playing surface (e.g., player interface areas 532, card screen 564, etc.) may be a unitary electronic display that is logically partitioned to permit game play from a plurality of players for receiving inputs from, and displaying game information to, the players, the dealer, or both.

Figure 8:
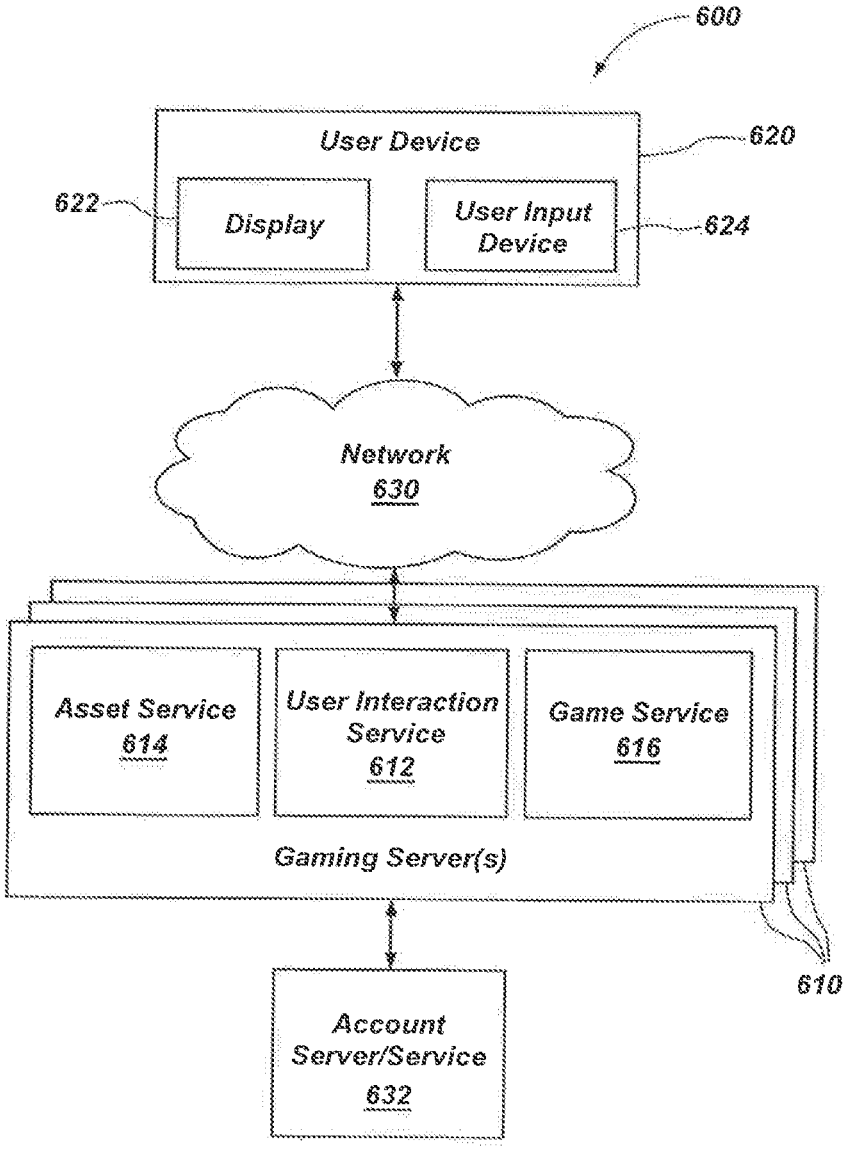
FIG. 8 is a schematic block diagram of a gaming system for implementing embodiments of wagering games in accordance with this disclosure.

In some embodiments, games in accordance with this disclosure may be administered using a system employing a client—server architecture (e.g., over the Internet, a local area network, etc.). FIG. 8 is a schematic block diagram of an illustrative gaming system 600 for implementing wagering games according to this disclosure. The system 600 may enable end users to remotely access game content. Such game content may include, without limitation, various types of wagering games such as card games, dice games, big wheel games, roulette, scratch off games ("scratchers"), and any other game where the game outcome is determined, in whole or in part, by one or more random events.

The games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The system 600 may include a gaming platform to establish a portal for an end user to access a game hosted by one or more servers 610 over a network 630. In some embodiments, games are accessed through a user interaction service 612. The system 600 enables players to interact with a user device 620 through a user input device 624 and a display 622 and to communicate with one or more servers 610 using a network 630 (e.g., the Internet). Typically, the user device is remote from the server 610 and the network is the worldwide web (i.e., the Internet).

In some embodiments, the servers 610 may be configured as a single server to administer wagering games in combination with the user device 620. In other embodiments, the servers 610 may be configured as separate servers for performing separate, dedicated functions associated with administering games. Accordingly, the following description also discusses "services" with the understanding that the various services may be performed by different servers or combinations of servers in different embodiments. As shown in FIG. 8, the servers 610 may include a user interaction service 612, a game service 616, and an asset service 614. In some embodiments, one or more of the servers 610 may communicate with an account server 632 performing an account service 632. As explained more fully below, for some types of games, the account service 632 may be separate and operated by a different entity than the servers 610; however, in some embodiments the account service 632 may also be operated by one or more of the servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may, for example, access, interpret, and apply game rules. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the servers 610. The client provided by the servers 610 for execution on the user device 620 may be any of a variety of implementations depending on the user device 620 and method of communication with the servers 610. In one embodiment, the user device 620 may connect to the servers 610 using a web browser, and the client may execute within a browser window or frame of the web browser. In another embodiment, the client may be a stand-alone executable on the user device 620.

For example, the client may comprise a relatively small amount of script (e.g., JAVASCRIPT®), also referred to as a "script driver," including scripting language that controls an interface of the client. The script driver may include simple function calls requesting information from the servers 610. In other words, the script driver stored in the client may merely include calls to functions that are externally defined by, and executed by, the servers 610. As a result, the client may be characterized as a "thin client." The client may simply send requests to the servers 610 rather than performing logic itself. The client may receive player inputs, and the player inputs may be passed to the servers 610 for processing and executing the wagering game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The servers 610 may include an asset service 614, which may host various media assets (e.g., text, audio, video, and image files) to send to the user device 620 for presenting the various wagering games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of games.

The servers 610 may include the game service 616, which may be programmed to administer games and determine game play outcomes to provide to the user interaction service 612 for transmission to the user device 620. For example, the game service 616 may include game rules for one or more games, such that the game service 616 controls some or all of the game flow for a selected wagering game as well as the determined game outcomes. The game service 616 may include pay tables and other game logic. The game service 616 may perform random number generation for determining random game elements of the game. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the servers 610. The user device 620 may be any electronic system capable of displaying gaming information, receiving user input, and communicating the user input to the servers 610. For example, the user device 620 may be a desktop computer, a laptop, a tablet computer, a set-top box, a mobile device (e.g., a smartphone), a kiosk, a terminal, or another computing device. As a specific, non-limiting example, the user device 620 operating the client may be an interactive electronic gaming system 300 (see FIG. 5), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the servers 610. The client may be illustrated within a casino webpage (or other interface) indicating that the client is embedded into a webpage, which is supported by a web browser executing on the user device 620.

In some embodiments, components of the system 600 may be operated by different entities. For example, the user device 620 may be operated by a third party, such as a casino or an individual, that links to the servers 610, which may be operated, for example, by a game service provider. Therefore, in some embodiments, the user device 620 and client may be operated by a different administrator than the operator of the game service 616. In other words, the user device 620 may be part of a third-party system that does not administer or otherwise control the servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity (e.g., a casino) may elect to perform each of these functions in-house, such as providing access to the user device 620, delivering the actual game content, and administering the gaming system 600.

The servers 610 may communicate with one or more external account servers 632 (also referred to herein as an account service 632), optionally through another firewall. For example, the servers 610 may not directly accept wagers or issue payouts. That is, the servers 610 may facilitate online casino gaming but may not be part of a self-contained online casino itself. Another entity (e.g., a casino or any account holder or financial system of record) may operate and maintain its external account service 632 to accept bets and make payout distributions. The servers 610 may communicate with the account service 632 to verify the existence of funds for wagering and to instruct the account service 632 to execute debits and credits. As another example, the servers 610 may directly accept bets and make payout distributions, such as in the case where an administrator of the servers 610 operates as a casino.

Additional features may be supported by the servers 610, such as hacking and cheating detection, data storage and archival, metrics generation, messages generation, output formatting for different end user devices, as well as other features and operations. For example, the servers 610 may include additional features and configurations as described in U.S. patent application Ser. No. 13/353,194, filed Jan. 18, 2012, and U.S. patent application Ser. No. 13/609,031, filed Sep. 10, 2012, both applications titled "Network Gaming Architecture, Gaming Systems, and Related Methods," the disclosure of each of which is incorporated herein in its entirety by this reference.

Figure 9:
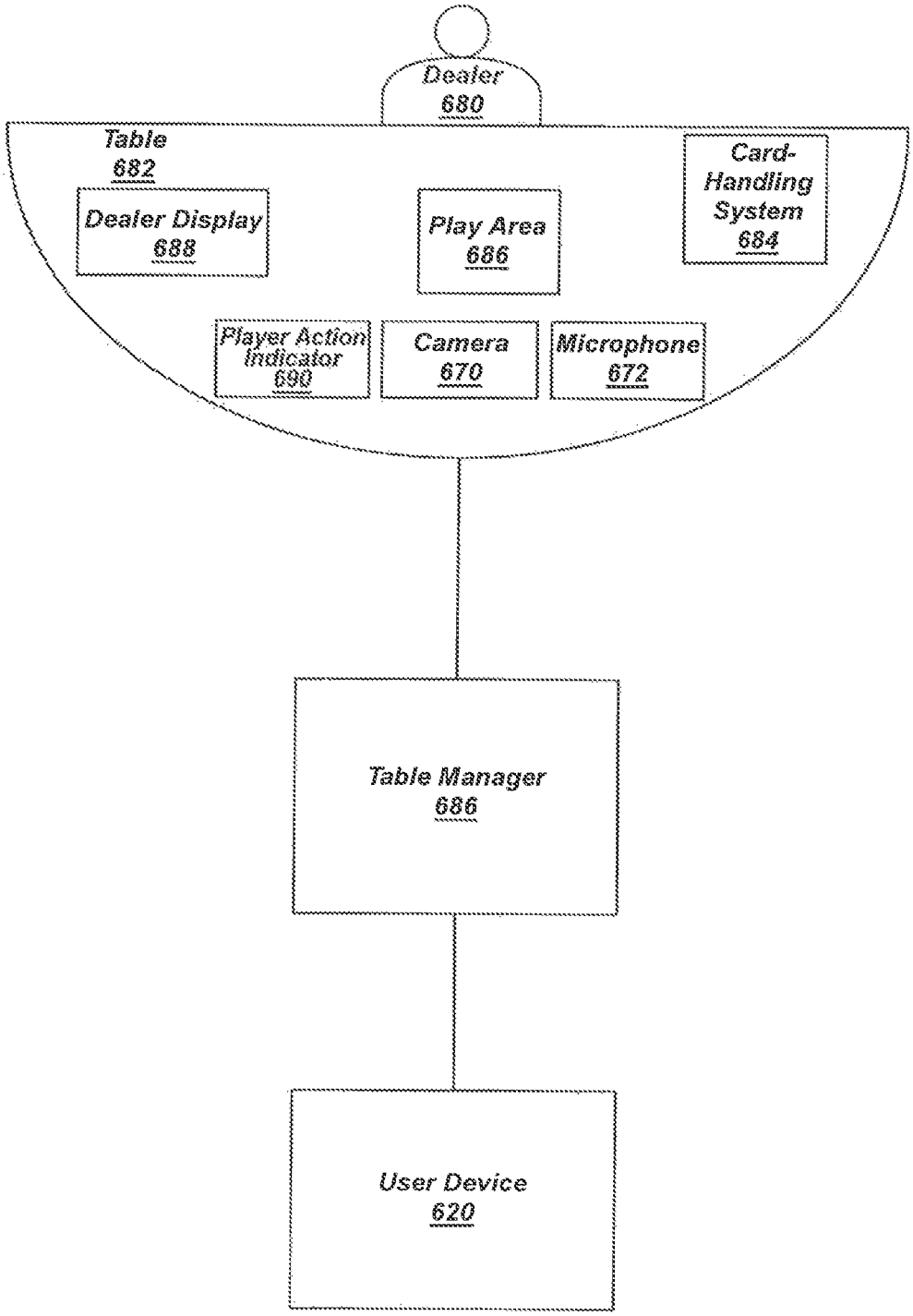
FIG. 9 is a schematic block diagram of a gaming system for implementing embodiments of wagering games including a live dealer feed.

FIG. 9 is a schematic block diagram of a table 682 for implementing games including a live dealer feed. Features of the system 600 (see FIG. 8) described above in connection with FIG. 8 may be utilized in connection with this embodiment, except as further described. Rather than cards being determined by computerized random processes, physical cards (e.g., from a standard, 52-card deck of playing cards) may be dealt by a live dealer 680 at a table 682 from a card-handling system 684. A table manager 686 may assist the dealer 680 in facilitating play of the game by transmitting a video feed of the dealer's actions to the user device 620 and transmitting player elections to the dealer 680. As described above, the table manager 686 may act as or communicate with a system 600 (see FIG. 8) (e.g., acting as the system 600 (see FIG. 8) itself or as an intermediate client interposed between and operationally connected to the user device 620 and the system 600 (see FIG. 8)) to provide gaming at the table 682 to users of the system 600 (see FIG. 8). Thus, the table manager 686 may communicate with the user device 620 through a network 630 (see FIG. 8), and may be a part of a larger online casino, or may be operated as a separate system facilitating game play. In various embodiments, each table 682 may be managed by an individual table manager 686 constituting a gaming device, which may receive and process information relating to that table. For simplicity of description, these functions are described as being performed by the table manager 686, though certain functions may be performed by an intermediary system 600 (see FIG. 8), such as the one shown and described in connection with FIG. 8. In some embodiments, the system 600 (see FIG. 8) may match remotely located players to tables 682 and facilitate transfer of information between user devices 620 and tables 682, such as placing of tokens or virtual tokens for participation and player option elections, without managing gameplay at individual tables. In other embodiments, functions of the table manager 686 may be incorporated into a system 600 (see FIG. 8).

The table 682 includes a camera 670 and optionally a microphone 672 to capture video and audio feeds relating to the table 682. The camera 670 may be trained on the dealer 680, play area 687, and card-handling system 684. As the game is administered by the dealer 680, the video feed captured by the camera 670 may be shown to the player using the user device 620, and any audio captured by the microphone 672 may be played to the player using the user device 620. In some embodiments, the user device 620 may also include a camera, microphone, or both, which may also capture feeds to be shared with the dealer 680 and other players. In some embodiments, the camera 670 may be trained to capture images of the card faces, chips, and chip stacks on the surface of the gaming table. Known image extraction techniques may be used to obtain card count and card rank and suit information from the card images. An example of suitable image extraction software is disclosed in U.S. Pat. No. 7,901,285, issued Mar. 8, 2011, to Tran et al., the disclosure of which is incorporated in this disclosure in its entirety by this reference.

Card and wager data in some embodiments may be used by the table manager 686 to determine game outcome. The data extracted from the camera 670 may be used to confirm the card data obtained from the card-handling system 684, to determine a player position that received a card, and for general security monitoring purposes, such as detecting player or dealer card switching, for example. Examples of card data include, for example, suit and rank information of a card, suit and rank information of each card in a hand, rank information of a hand, and rank information of every hand in a round of play.

The live video feed permits the dealer to show cards dealt by the card-handling system 684 and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

The card-handling system 684 may be as shown and described previously in connection with FIG. 4. The play area 686 depicts player positions for playing the game, such as shown in FIGS. 2 and 3. As determined by the rules of the game, the player at the user device 620 may be presented options for responding to an event in the game using a client as described with reference to FIG. 8.

Player elections may be transmitted to the table manager 686, which may display player elections to the dealer 680 using a dealer display 688 and player action indicator 690 on the table 682. For example, the dealer display 688 may display information regarding where to deal the next card or which player position is responsible for the next action.

In some embodiments, the table manager 686 may receive card information from the card-handling system 684 to identify cards dealt by the card-handling system 684. For example, the card-handling system 684 may include a card reader to determine card information from the cards. The card information may include the rank and suit of each dealt card and hand information.

The table manager 686 may apply game rules to the card information, along with the accepted player decisions, to determine gameplay events and wager results. Alternatively, the wager results may be determined by the dealer 680 and input to the table manager 686, which may be used to confirm automatically determined results by the gaming system.

The data extracted from the camera 670 may be used to confirm the card data obtained from the card-handling system 684, to determine a player position that received a card, and for general security monitoring purposes, such as detecting player or dealer card switching, for example.

The live video feed permits the dealer to show cards dealt by the card-handling system 684 and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

Figure 10:
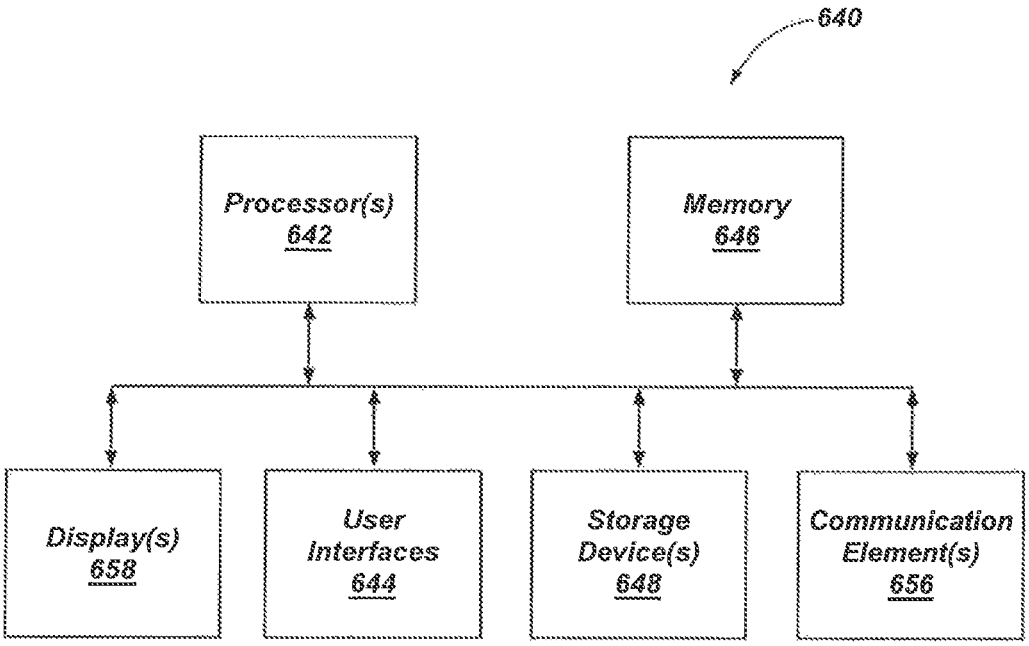
FIG. 10 is a block diagram of a computer for acting as a gaming system for implementing embodiments of wagering games in accordance with this disclosure.

FIG. 10 is a simplified block diagram showing elements of computing devices that may be used in systems and apparatuses of this disclosure. A computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications including the computing instructions for administering wagering games of the present disclosure.

The processors 642 may be configured as a general-purpose processor such as a microprocessor, but in the alternative, the general-purpose processor may be any processor, controller, microcontroller, or state machine suitable for carrying out processes of the present disclosure. The processor 642 may also be implemented as a combination of computing devices, such as a combination of a DSP and a microprocessor, a plurality of microprocessors, one or more microprocessors in conjunction with a DSP core, or any other such configuration.

A general-purpose processor may be part of a general-purpose computer. However, when configured to execute instructions (e.g., software code) for carrying out embodiments of the present disclosure the general-purpose computer should be considered a special-purpose computer. Moreover, when configured according to embodiments of the present disclosure, such a special-purpose computer improves the function of a general-purpose computer because, absent the present disclosure, the general-purpose computer would not be able to carry out the processes of the present disclosure. The processes of the present disclosure, when carried out by the special-purpose computer, are processes that a human would not be able to perform in a reasonable amount of time due to the complexities of the data processing, decision making, communication, interactive nature, or combinations thereof for the present disclosure. The present disclosure also provides meaningful limitations in one or more particular technical environments that go beyond an abstract idea. For example, embodiments of the present disclosure provide improvements in the technical field related to the present disclosure.

The memory 646 may be used to hold computing instructions, data, and other information for performing a wide variety of tasks including administering wagering games of the present disclosure. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light-emitting diode displays, liquid crystal displays, cathode ray tubes, and the like. In addition, the display 658 may be configured with a touch-screen feature for accepting user input as a user interface element 644.

As non-limiting examples, the user interface elements 644 may include elements such as displays, keyboards, push buttons, mice, joysticks, haptic devices, microphones, speakers, cameras, and touchscreens.

As non-limiting examples, the communication elements 656 may be configured for communicating with other devices or communication networks. As non-limiting examples, the communication elements 656 may include elements for communicating on wired and wireless communication media, such as for example, serial ports, parallel ports, Ethernet connections, universal serial bus (USB) connections, IEEE 1394 ("firewire") connections, THUNDERBOLT™ connections, BLUETOOTH® wireless networks, ZigBee wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one non-limiting example, the memory 646 may be divided into cache memory, graphics memory, and main memory. Each of these memories may communicate directly or indirectly with the one or more processors 642 on separate buses, partially combined buses, or a common bus.

As a specific, non-limiting example, various methods and features of the present disclosure may be implemented in a mobile, remote, or mobile and remote environment over one or more of Internet, cellular communication (e.g., Broadband), near field communication networks and other communication networks referred to collectively herein as an iGaming environment. The iGaming environment may be accessed through social media environments such as FACEBOOK® and the like. DragonPlay Ltd, acquired by Bally Technologies Inc., provides an example of a platform to provide games to user devices, such as cellular telephones and other devices utilizing ANDROID®, iPHONE® and FACEBOOK® platforms. Where permitted by jurisdiction, the iGaming environment can include pay-to-play (P2P) gaming where a player, from their device, can make value based wagers and receive value based awards. Where P2P is not permitted the features can be expressed as entertainment only gaming where players wager virtual credits having no value or risk no wager whatsoever such as playing a promotion game or feature.

Figure 11:
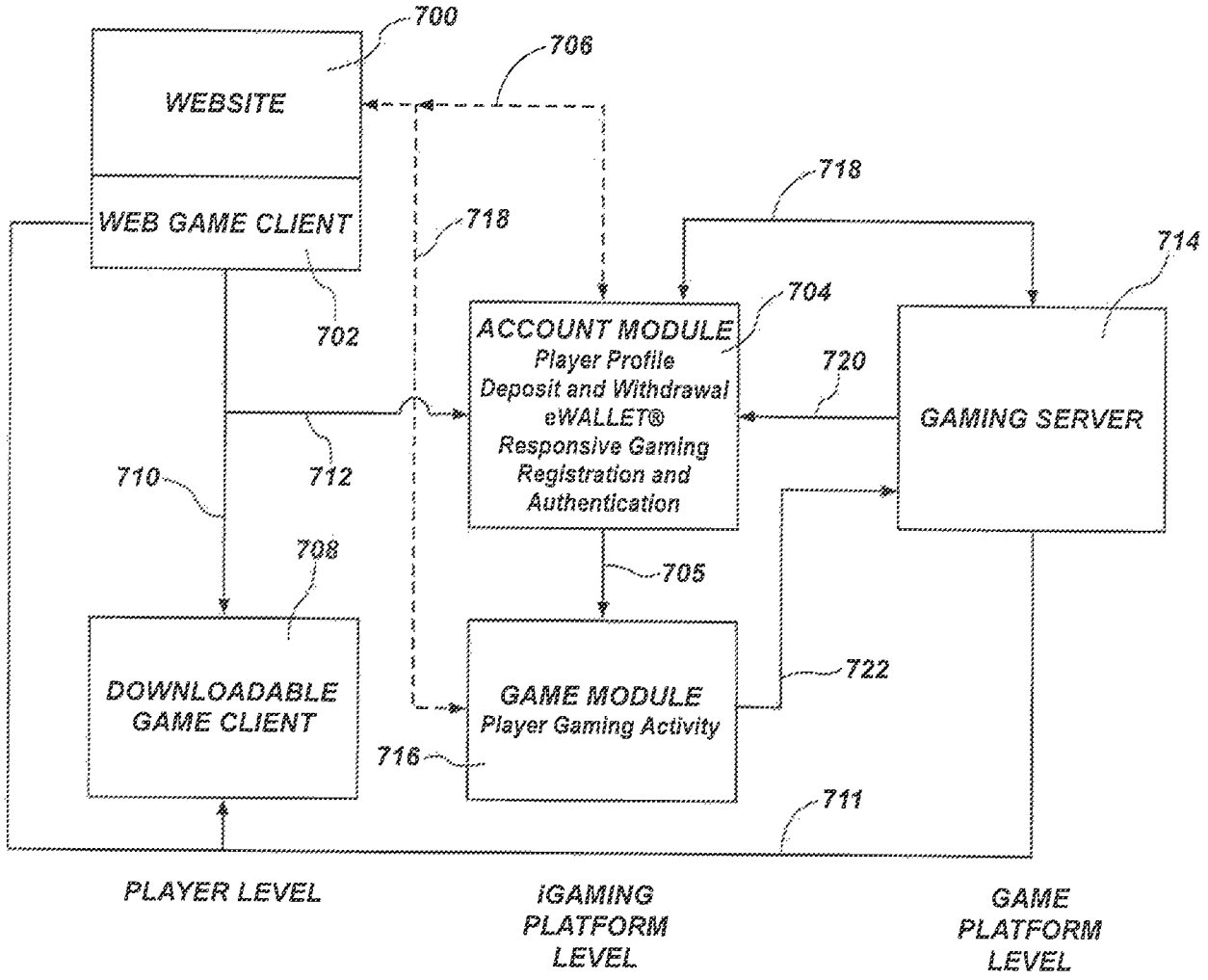
FIG. 11 illustrates an embodiment of data flows between various applications/services for supporting the game, feature or utility of the present disclosure for mobile/interactive gaming.

FIG. 11 illustrates an illustrative embodiment of information flows in an iGaming environment. At a player level, the player or user accesses a site hosting the activity such as a website 700. The website 700 may functionally provide a web game client 702. The web game client 702 may be, for example, represented by a game client 708 downloadable at information flow 710, which may process applets transmitted from a gaming server 714 at information flow 711 for rendering and processing game play at a player's remote device. Where the game is a P2P game, the server 714 may process value-based wagers (e.g., money wagers) and randomly generate an outcome for rendition at the player's device. In some embodiments, the web game client 702 may access a local memory store to drive the graphic display at the player's device. In other embodiments, all or a portion of the game graphics may be streamed to the player's device with the web game client 702 enabling player interaction and display of game features and outcomes at the player's device.

The website 700 may access a player-centric, iGaming-platform-level account module 704 at information flow 706 for the player to establish and confirm credentials for play and, where permitted, access an account (e.g., an eWallet) for wagering. The account module 704 may include or access data related to the player's profile (e.g., player-centric information desired to be retained and tracked by the host), the player's electronic account, deposit, and withdrawal records, registration and authentication information, such as username and password, name and address information, date of birth, a copy of a government issued identification document, such as a driver's license or passport, and biometric identification criteria, such as fingerprint or facial recognition data, and a responsible gaming module containing information, such as self-imposed or jurisdictionally imposed gaming restraints, such as loss limits, daily limits and duration limits. The account module 704 may also contain and enforce geo-location limits, such as geographic areas where the player may play P2P games, user device IP address confirmation, and the like.

The account module 704 communicates at information flow 705 with a game module 716 to complete log-ins, registrations, and other activities. The game module 716 may also store or access a player's gaming history, such as player tracking and loyalty club account information. The game module 716 may provide static web pages to the player's device from the game module 716 through information flow 718, whereas, as stated above, the live game content may be provided from the gaming server 714 to the web game client through information flow 711.

The gaming server 714 may be configured to provide interaction between the game and the player, such as receiving wager information, game selection, inter-game player selections or choices to play a game to its conclusion, and the random selection of game outcomes and graphics packages, which, alone or in conjunction with the downloadable game client 708/web game client 702 and game module 716, provide for the display of game graphics and player interactive interfaces. At information flow 718, player account and log-in information may be provided to the gaming server 714 from the account module 704 to enable gaming. Information flow 720 provides wager/credit information between the account module 704 and gaming server 714 for the play of the game and may display credits and eWallet availability. Information flow 722 may provide player tracking information for the gaming server 714 for tracking the player's play. The tracking of play may be used for purposes of providing loyalty rewards to a player, determining preferences, and the like.

All or portions of the features of FIG. 11 may be supported by servers and databases located remotely from a player's mobile device and may be hosted or sponsored by regulated gaming entity for P2P gaming or, where P2P is not permitted, for entertainment only play.

The game as described herein can also be played as a variation of Blackjack in a "stadium" version where multiple players share the same hand as described in Reabe, U.S. Pat. No. 7,954,821 issued Jun. 7, 2011 and titled "World Cup of Blackjack" and Vuong et al, US Pub. App. 2002/0147042 filed Feb. 14, 2001 and titled "System and Method for Detecting the Result of a Game of Chance" the disclosures of which are incorporated by reference.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A method for playing a token collecting game including features of Blackjack with physical playing cards between one or more physical players and a physical dealer and using a card reading device adapted to read at least the rank of cards, the method comprising:

accepting from each player at a designated player position on a physical game layout a token to indicate participation in the game;

distributing an initial hand of physical playing cards to each participating player at their respective playing position;

distributing and reading by the card reading device a hand of two cards to the dealer, at least one of the dealer's cards dealt face down, the card reading device issuing signals corresponding to the values of the cards of the dealer's hand;

configuring a data processor in communication with the card reading device to receive the signals for (a) summing according to Blackjack the values of the cards of the dealer's hand, (b) determining, based upon the determined sum of the dealer's hand, if an additional card is required to complete the dealer's hand to a final hand value, (c) if an additional card is required generating a dealer perceptible signal and in response thereto (d) the dealer causing distribution of an additional card, the additional card dealt face down, and reading the value of additional card and summing according to Blackjack the values of all cards of the dealer's hand and (d) repeating steps (b)-(d) until the dealer's hand is completed;

for each player dealing none, one or more cards to complete each initial player hand to a player final hand value;

exposing the cards of the dealer final hand and resolving the dealer final hand value against each player final hand value; and awarding one or more tokens to a player when their final hand value is a winner versus the dealer final hand value.

2. The method of claim 1 comprising configuring the processor to include program instructions in accordance to the predetermined rule set and to issue a dealer perceptible signal when the dealer final hand has been completed.

3. The method of claim 2 comprising configuring the processor for to include program instructions in accordance to the predetermined rule set of repeating steps (a)-(d) until the dealer hand as a value of ≤a Hard 17 according to the rules of Blackjack.

4. The method of claim 1 comprising configuring the processor to control a video display to display a visual signal to the dealer to deal the additional card to the dealer's hand.

5. Apparatus for facilitating the play of a card game having features of Blackjack where (1) a hand of two playing cards is dealt to each player and a hand of two cards is dealt to a dealer, (2) the dealer completes their hand with unrevealed cards to a dealer final hand before each Player complete their hands to player final hands according to the rules of Blackjack and (3) each player final hand is resolved against the dealer final hand, the apparatus comprising:

a housing for holding an inventory of physical playing cards, the housing including a playing card dispensing chute;

a card reader for reading the values of cards dispensed from the chute;

a display for the dealer;

a computer processor configured to receive signals from the card reader for (a) determining the values of the playing cards dealt to the dealer hand, (b) summing the values of the cards according to the rules of Blackjack and predetermined rules for completing the dealer hand, (c) determining according to (b) whether an additional playing card is required to be dealt to the dealer hand and if so control the display to indicate the requirement for an additional card, (d) determining the value of the additional card dealt face down to the dealer hand, and (e) summing the value of the dealer's hand with one or more additional cards until a dealer final hand is assembled;

whereby the dealer completes their hand to a dealer final hand with none, one or more undisclosed cards before each player completes their hand to a player final hand providing each player with information as to the number of cards required to complete the final dealer hand.

6. The apparatus of claim 5, the computer processor being further configured to include program instructions in accordance to the predetermined rule set and to issue a dealer perceptible signal when the dealer final hand has been completed.

7. The apparatus of claim 6, the computer processor being further configured to include program instructions in accordance to the predetermined rule set of repeating steps (a)-(d) until the dealer hand as a value of ≤a Hard 17 according to the rules of Blackjack.

8. The apparatus of claim 5, the computer processor being further configured to control a video display to display a visual signal to the dealer to deal the additional card to the dealer's hand.

9. Apparatus for facilitating the play of a card game having features of Blackjack where (1) a hand of two playing cards is dealt to at least a first player and a hand of two cards is dealt to a dealer, (2) the dealer completes their hand with unrevealed cards to form a dealer final hand before the first player completes their hand to form a player final hand according to the rules of Blackjack and (3) each player final hand is resolved against the dealer final hand, the apparatus comprising:

a housing for holding an inventory of physical playing cards, the housing including a playing card dispensing chute;

a card reader for reading the values of cards dispensed from the chute;

a game table associated with the first player for displaying the final dealer hand and the final player hand to the first player;

a computer processor configured to receive signals from the card reader for (a) determining the values of the playing cards dealt to the dealer hand, (b) summing the values of the cards according to the rules of Blackjack and predetermined rules for completing the dealer hand, (c) determining according to (b) whether an additional playing card is required to be dealt to the dealer hand and if so control the display to indicate the requirement for an additional card, (d) determining the value of the additional card dealt face down to the dealer hand, and (e) summing the value of the dealer's hand with one or more additional cards until a dealer final hand is assembled;

whereby the dealer completes their hand to a dealer final hand with none, one or more undisclosed cards before each player completes their hand to a player final hand providing each player with information as to the number of cards required to complete the final dealer hand.

10. The apparatus of claim 9, wherein the housing and card reader are located at a different physical location than the game table.

11. The apparatus of claim 9, wherein the game table displays virtual cards to the first player, the virtual cards being representations of physical playing cards read by the card reader after being dispensed from the chute.

12. The apparatus of claim 11, wherein the game table is in electronic communication with the card reader.

13. The apparatus of claim 9, wherein the game table include at least one electronic display device.

14. The apparatus of claim 13, the computer processor being further configured to control a video display to display a visual signal to the dealer to deal the additional card to the dealer's hand and to control the electronic display device to display virtual cards, representing the physical playing cards read by the card reader after being dispensed from the chute, to the first player.

15. The apparatus of claim 9, the computer processor being further configured to include program instructions in accordance to the predetermined rule set and to issue a dealer perceptible signal when the dealer final hand has been completed.

16. The apparatus of claim 15, the computer processor being further configured to include program instructions in accordance to the predetermined rule set of repeating steps (a)-(d) until the dealer hand as a value of ≤a Hard 17 according to the rules of Blackjack.

17. The apparatus of claim 9, the computer processor being further configured to control a video display to display a visual signal to the dealer to deal the additional card to the dealer's hand.

* * * * *